US012252987B1

(12) United States Patent
Lipoma et al.

(10) Patent No.: US 12,252,987 B1
(45) Date of Patent: Mar. 18, 2025

(54) ANNULAR PISTON PILE DRIVER

(71) Applicant: Dig Energy, Inc., Manchester, NH (US)

(72) Inventors: Thomas Lipoma, Hopkinton, NH (US); Thomas Michael Ikuss, III, Nashua, NH (US)

(73) Assignee: Dig Energy, Inc., Manchester, NH (US)

( * ) Notice: Subject to any disclaimer, the term of this patent is extended or adjusted under 35 U.S.C. 154(b) by 0 days.

(21) Appl. No.: 18/622,127

(22) Filed: Mar. 29, 2024

(51) Int. Cl.
*E21B 7/18* (2006.01)
*E21B 23/04* (2006.01)

(52) U.S. Cl.
CPC ..... *E21B 7/18* (2013.01); *E21B 23/042* (2020.05); *E21B 2200/06* (2020.05)

(58) Field of Classification Search
CPC ..... E12B 7/18; E21B 2200/06; E21B 34/14; E21B 21/20; E21B 33/14; E21B 23/042; E21B 34/102; E21B 34/10; E21B 47/06
See application file for complete search history.

(56) References Cited

U.S. PATENT DOCUMENTS

| | | | | |
|---|---|---|---|---|
| 6,289,998 | B1 | 9/2001 | Krueger et al. | |
| 2014/0251619 | A1* | 9/2014 | George | E21B 34/063 166/305.1 |
| 2015/0233208 | A1* | 8/2015 | Muscroft | E21B 34/063 166/321 |
| 2016/0258232 | A1 | 9/2016 | Harper | |
| 2019/0136664 | A1* | 5/2019 | Roessler | E21B 34/063 |
| 2020/0263519 | A1* | 8/2020 | Roberts | E21B 34/102 |
| 2021/0079759 | A1* | 3/2021 | Benson | E21B 43/14 |
| 2022/0364438 | A1* | 11/2022 | Mackay | E21B 34/14 |

* cited by examiner

*Primary Examiner* — Yong-Suk (Philip) Ro
(74) *Attorney, Agent, or Firm* — Hathaway P. Russell; Stephen J. Kenny; Foley Hoag LLP

(57) ABSTRACT

An annular piston pile driver for use with a fluid jet drill system for boring holes in both residential and non-residential areas for geothermal energy shafts. The annular piston pile driver having an inner cylinder an outer cylinder, a piston, a driver coupling, an upper sealing component, and a lower sealing component. The outer cylinder circumscribing the inner cylinder such that the inner cylinder and the outer cylinder form an annular space therebetween. The piston comprising a piston shaft and a piston head, wherein the piston is disposed within the annular space and configured to travel along an axis.

13 Claims, 23 Drawing Sheets

140

ANNULAR PISTON PILE DRIVER

FIELD OF THE DISCLOSED SUBJECT MATTER

The disclosed subject matter relates to an annular piston pile driver. Particularly, the present disclosed subject matter is directed to an annular piston pile driver for use with a fluid jet drill system with geothermal applications to guide movement of the drill string through a bore hole (for indoor and/or outdoor geothermal applications).

BACKGROUND OF THE DISCLOSED SUBJECT MATTER

There are methods for drilling. These processes are usually fluid intensive and chemically introductive and they add time, money, and contamination to the operation.

Because of the typically high cost of drilling operations, almost all existing geothermal power generation is limited to large, high efficiency systems that require extremely large upfront capital investment and must be installed in locations that have an abnormally high subsurface temperature gradient. Conventional drilling systems require large diameter boreholes, with excessive drilling forces (e.g. torque) that often over pressurize the borehole.

In addition, while the demand for renewable energy sources is increasing, geothermal energy is not currently able to meet that demand because of the high cost and limited availability of installation sites. Further, because geothermal heat flux is distributed over the entire surface of the earth, only a small amount of energy can be sourced from any one location before the subsurface rock starts to cool down.

In existing drilling operations, a tremendous amount of force needs to be placed on the drill bit to crush the material for drilling. This force is typically transmitted through large steel drill strings. At depth, the weight of the drill string alone can provide enough downward pressure but at the surface the drilling rig must provide some downward force. In addition, as drill bits wear out the entire drill string must be lifted to the surface to change out the drill head. This involves lifting the entire massive column of drill string at once. To accomplish this, a drilling rig typically needs to be an extremely large and expensive piece of equipment that takes up a significant amount of space.

There thus remains a need for an efficient and economic method and system for an annular piston pile driver as described herein.

SUMMARY OF THE DISCLOSED SUBJECT MATTER

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes an annular piston pile driver, including, an inner cylinder having an upper end and a lower end, extending along a first axis therebetween, an outer cylinder having an upper end and a lower end, the outer cylinder circumscribing the inner cylinder and extending along the first axis, wherein the inner cylinder and an outer cylinder form an annular space therebetween, a piston comprising a piston shaft having an upper end and a lower end, and a piston head disposed at the lower end thereof, wherein the piston is disposed within the annular space and configured to travel along the first axis, a driver coupling releasably coupled to the piston shaft and disposed at the upper end of the piston shaft, an upper sealing component disposed at the upper end of the outer cylinder and the piston shaft and a lower sealing component disposed at the lower end of the outer cylinder and the inner cylinder.

To achieve these and other advantages and in accordance with the purpose of the disclosed subject matter, as embodied and broadly described, the disclosed subject matter includes a system for drilling a borehole, the system including an inner cylinder extending along a first axis, an outer cylinder circumscribing the inner cylinder and extending along the first axis, wherein the outer cylinder is concentrically spaced from the inner cylinder defining an annular space therebetween, a piston having, a piston shaft extending along the first axis between the inner cylinder and the outer cylinder and a piston head coupled to the piston shaft, wherein the piston is configured to translate within the annular space, a driver coupling coupled to the piston shaft, a driver assembly having a motor, the driver assembly releasably coupled to the driver coupling, a drill string coupled to the driver assembly, the drill string extending along the first axis and within the inner cylinder, piston, and outer cylinder, and a fluid source in fluid communication with the annular space and the piston head.

The disclosed subject matter also includes a method for drilling a borehole, the method including installing an annular piston pile driver within a borehole having a first depth, wherein the annular piston pile driver including an inner cylinder, an outer cylinder circumscribing the inner cylinder forming an annular space therebetween, and a piston configured to translate between an upper position and a lower position within the annular space, and a driver assembly, installing a first drill string length within the annular piston pile driver, and coupling the driver assembly to the first drill string length, retreating/retracting the piston from a lower position to an upper position, and coupling the piston to the driver assembly, advancing the piston from the upper position to the lower position, thereby drilling a borehole to a second depth, disconnecting the piston from the driver assembly and the driver assembly from the first drill string length, coupling a second drill string length to the first drill string length, coupling the driver assembly to the second drill string length, retreating the piston from the lower position to the upper position and coupling the piston to the driver assembly and readvancing the piston from the upper position to the lower position, thereby drilling the borehole to a third depth.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

BRIEF DESCRIPTION OF THE DRAWINGS

A detailed description of various aspects, features, and embodiments of the subject matter described herein is provided with reference to the accompanying drawings, which are briefly described below. The drawings are illustrative and are not necessarily drawn to scale, with some components and features being exaggerated for clarity. The drawings illustrate various aspects and features of the present subject matter and may illustrate one or more embodiment(s) or example(s) of the present subject matter in whole or in part.

DETAILED DESCRIPTION OF AN EXEMPLARY EMBODIMENT

Figure 1A:
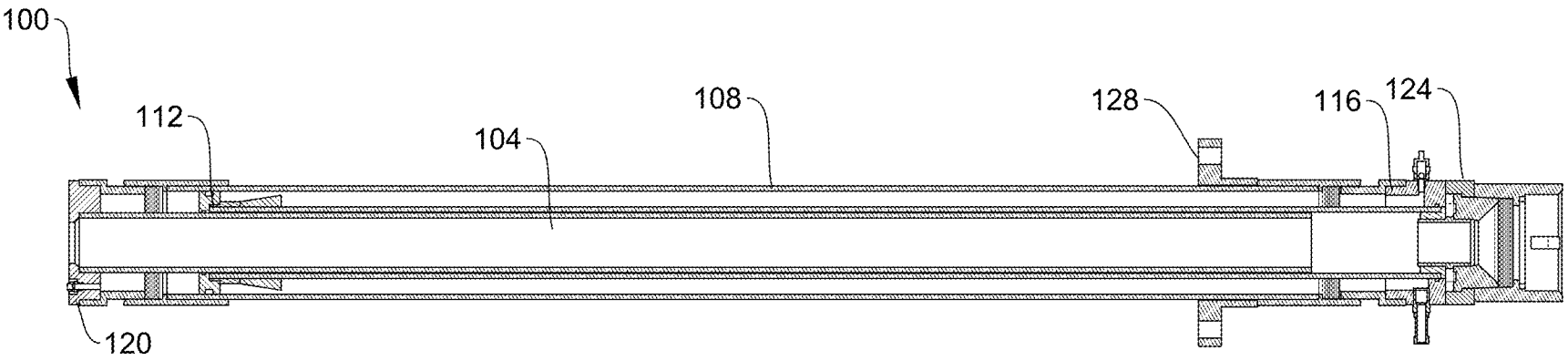
FIGS. 1A-1B are cross-sectional and side views of an annular piston pile driver in accordance with the disclosed subject matter.

Reference will now be made in detail to exemplary embodiments of the disclosed subject matter, an example of which is illustrated in the accompanying drawings. The method and corresponding steps of the disclosed subject matter will be described in conjunction with the detailed description of the system.

The methods and systems presented herein may be used for an annular piston pile driver. The disclosed subject matter is particularly suited for drilling bore holes in both residential and non-residential areas for geothermal energy shafts. For purposes of explanation and illustration, and not limitation, an exemplary embodiment of the system in accordance with the disclosed subject matter is shown in FIG. 1 and is designated generally by reference character 100. Similar reference numerals (differentiated by the leading numeral) may be provided among the various views and Figures presented herein to denote functionally corresponding, but not necessarily identical structures.

This disclosure relates to drilling systems and geothermal energy capture/production systems and, in particular, a low cost system for producing and installing a complete geothermal direct energy generation system. In various embodiments, the system may utilize water jets, thereby reducing wear on the drill head and greatly reducing or eliminating the need for lifting the drill head to the surface for maintenance. In various embodiments, the borehole may be approximately the diameter of the annular piston pile driver and further the drill string itself, at the appropriate depth, thereby providing a borehole casing in the drill string assembly itself. In various embodiments, the system provided herein may exhibit low or zero rotational or linear force on the drill head, thus allowing the drill head to rotate and move freely without being impacted by the earth yet to be removed. In various embodiments, the drill string weight may be matched with the frictional force exhibited on the drill string by the borehole itself, allowing the weight of the drill string to be suspended within the borehole and advance at the appropriate pace.

In various embodiments, controlling the motion of the drill string may be accomplished using the systems and methods described herein. In various embodiments, the drill string is configured to move through the center of an annular piston, said annular piston utilizing standard pipe lengths in order to lower the cost of the overall system (however customizable lengths can be employed as well with the present disclosure). In various embodiments, the system and methods provided herein may be controlled using a single fluid system, such as a hydraulic or pneumatic system. In various embodiments, the methods and systems herein may provide for a self-contained system with no external moving parts, such that the system can be left underground, expanding the possible borehole drilling locations.

Annular Piston Pile Driver

Figure 1B:
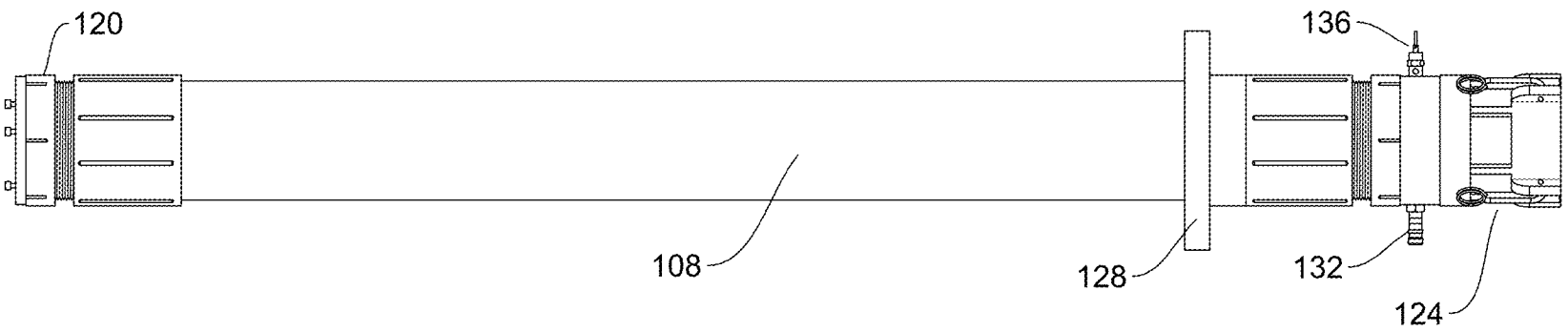

Referring now to FIGS. 1A-1B, the annular piston pile driver 100 is shown in cross-sectional and side views, respectively. Annular piston pile driver 100 may be interchangeably referred to as a "lander". The lander 100 includes an inner cylinder 104. Inner cylinder 104 may have a first end and a second end, defining a length spanning along a first axis therebetween. In various embodiments, inner cylinder 104 may be a length of standard pipe, such as PVC pipe. In various embodiments, inner cylinder 104 may be formed from one or more performance plastics, metals, metal alloys, or a combination thereof. For example, inner cylinder 104 may be formed from aluminum or steel. In various embodiments, inner cylinder 104 may have an inner diameter of 2 to 2.5 inches. In various embodiments, inner cylinder 104 may have an outer diameter of 2 to 2.5 inches.

In various embodiments, the inner cylinder 104 may have a wall thickness that is constant along its length. In various embodiments, the inner cylinder 104 may have a varying wall thickness along its length, for example, thicker walls proximate a midpoint relative to thinner walls proximate the first and second ends. In various embodiments, a first end of the inner cylinder 104 may be an upper end of the cylinder and a second end may be a lower end of the inner cylinder 104. For example, and without limitation, the inner cylinder 104 may be oriented vertically relative to a horizontal portion of the earth, such as ground level or the concrete/cement floor of a basement of a building, such as a residential building or house. In various embodiments, one or both ends of the inner cylinder 104 may include threaded portions configured to threadably couple to other components of the lander 100. In various embodiments, any portion of inner cylinder 104 may include cutouts, flats, channels or the like configured to receive an O-ring, gasket or other sealing components.

With continued reference to FIGS. 1A-1B, lander 100 includes an outer cylinder 108. Outer cylinder 108 may have a first end and a second end, defining a length therebetween, said length extending along the first axis. Outer cylinder 108 may be concentrically disposed about the inner cylinder 104 such that the inner cylinder 104 has an outer surface spaced from the inner surface of the outer cylinder 108. In various embodiments, the ends of the inner cylinder 104 and outer cylinder 108 may be coplanar, such that the inner and outer cylinders are the same length. In various embodiments, the inner cylinder and outer cylinder may be of different lengths, for example, the inner cylinder 104 may extend a greater length than outer cylinder 108 such that a first end of inner cylinder 104 is coplanar with the first end of the outer cylinder 108, and the second end of inner cylinder 104 extends from the second end of outer cylinder 108. In various embodiments, outer cylinder 108 may have an inner diameter from 4-5 inches. In various embodiments, outer cylinder 108 may have an outer diameter from 4-5 inches. In various embodiments, outer cylinder 108 may have a constant wall thickness along its length. In various embodiments, the outer cylinder 108 may have a varying wall thickness along its length, for example, thicker walls proximate a midpoint relative to thinner walls proximate the first and second ends. In various embodiments, a first end of the outer cylinder 108 may be an upper end of the cylinder and a second end may be a lower end of the outer cylinder 108. For example, and without limitation, the outer cylinder 108 may be oriented vertically relative to a horizontal portion of the earth, such as ground level or the concrete/cement floor of a basement of a building, such as a residential building or house. In various embodiments, one or both ends of the outer cylinder 108 may include threaded portions configured to threadably couple to other components of the lander 100. In various embodiments, any portion of outer cylinder 108 may include cutouts, flats, channels or the like configured to receive an O-ring, gasket or other sealing components.

With continued reference to FIGS. 1A-1B, lander 100 includes a mounting flange 128. Mounting flange 128 may circumscribe the outer surface of the outer cylinder 108. Mounting flange 128 may be formed as an annulus or ring-shape plate configured to couple said outer cylinder 108 to the surface of the earth when the lander 100 is disposed underground (e.g. with flange 128 being placed above and circumscribing a bore hole). Mounting flange 128 may be configured to retain a seal between the borehole and the atmosphere above ground. Mounting flange 128 may extend a radial distance from outer cylinder 108. In various embodiments, mounting flange 128 may be coupled to outer cylinder 108 via chemical adhesives, mechanical fasteners or a combination thereof. In various embodiments, mounting flange 128 may be retained in the proper alignment through complementary geometry with outer cylinder 108, such as abutting against one or more collars, such as a portion of top sealing component 116. In various embodiments, mounting flange 128 may include a plurality of radially spaced through holes configured to receive a mechanical fasteners, such as a stake or screw, said mechanical fastener configured to couple the mounting flange 128 to the surface of the earth or another surface in which the borehole is formed.

Figure 11A:
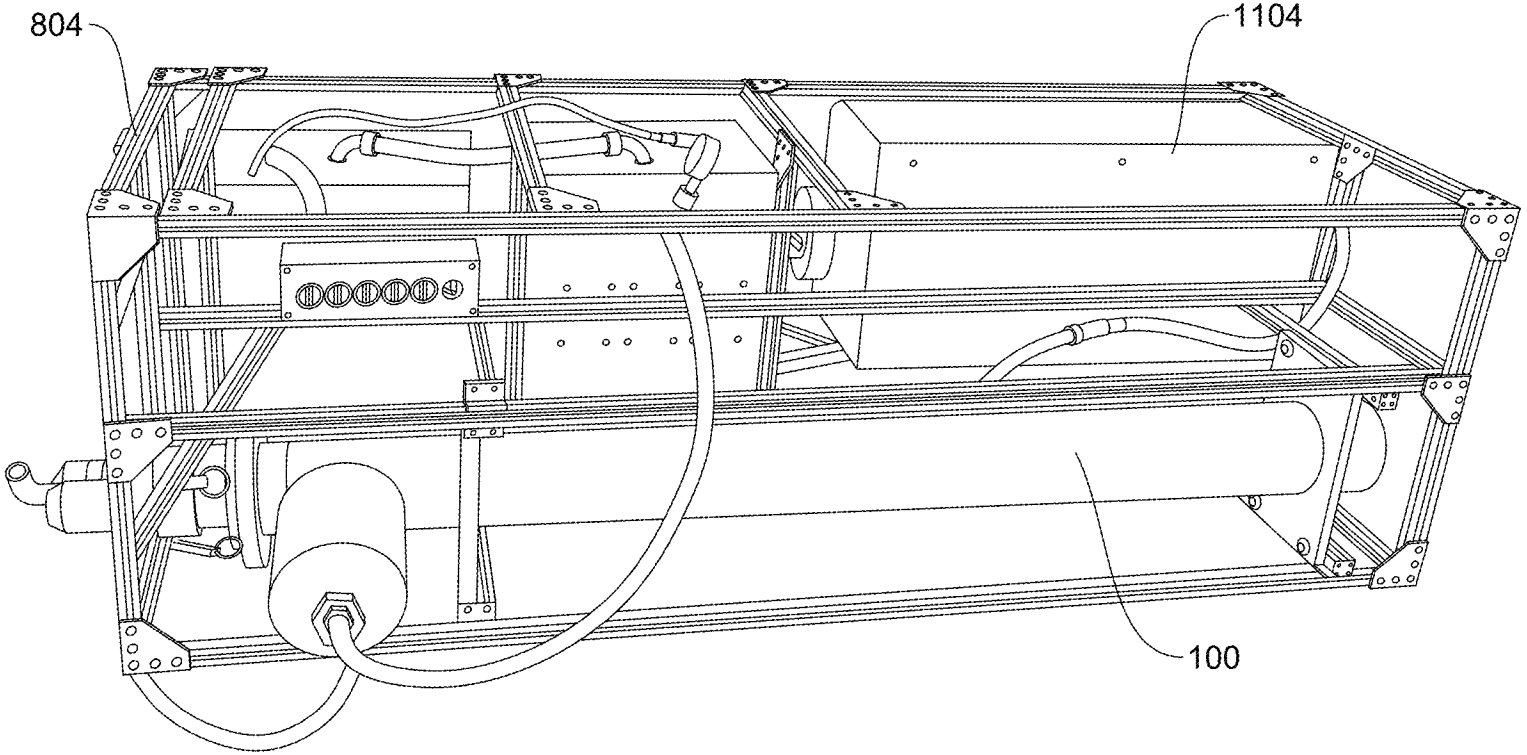
FIGS. 11A-11B are perspective views of the annular piston pile driver arranged within a frame and including a tank, in accordance with the disclosed subject matter.
Figure 11B:
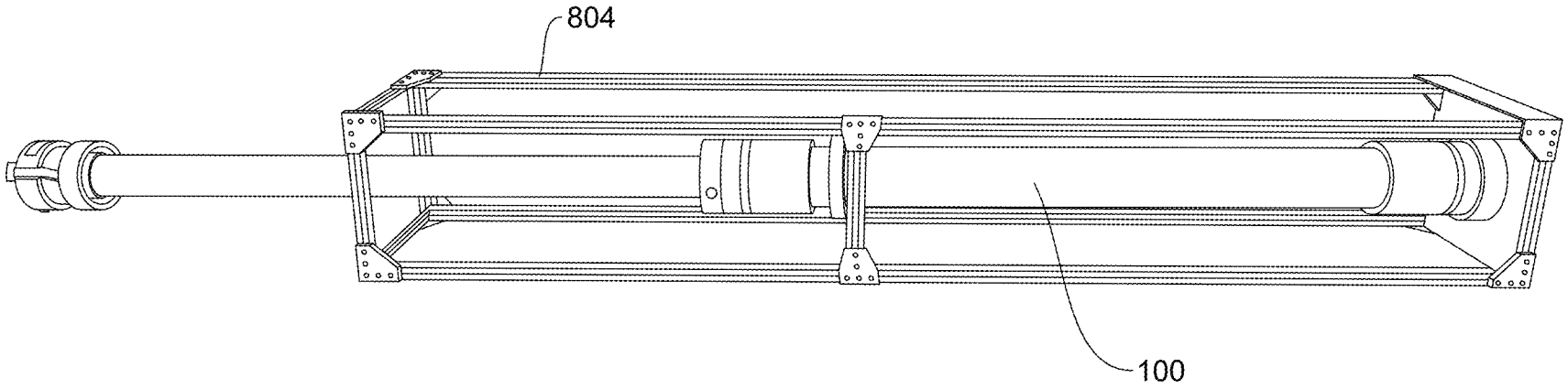

In various embodiments, mounting flange 128 may be disposed at angle to ground level to affect non-vertical drilling. In various embodiments, mounting flange 128 may include a spacer or non-planar section (e.g. wedge) configured to orient the annular piston pile driver 100 at an angle relative to the horizontal ground. The spacer can be expandable (e.g. pneumatic "balloon" or mechanical "spring") which can raise select portions of the flange 128 relative to the ground to achieve any desired pitch or angle so that the upper surface of the flange 128 remains horizontal). In various embodiments, the mounting flange 128 may be coupled to a frame (as will be described below) and disposed above ground level, thereby suspending the annular piston pile driver 100 above ground level for drilling at either vertical or non-vertical orientations. In various embodiments, the mounting flange 128 may include one or more gimbals or other rotational bearings configured to retain the annular piston pile driver 100 at various angles relative to the mounting flange 128, above or at ground level. In various embodiments, as shown in FIGS. 11A and 11B, annular piston pile driver 100 may be retained above ground level in a frame formed from metal struts, rails, bars or the like. In various embodiments, any of the systems and components described herein may include a fluid source, such as a tank 1104 or other receptacle configured to hold and recycle fluid, such as water, for advancing or retreating the piston, as described herein. Additionally, a seal (e.g. gasket or O-ring0 can be placed on the bottom of the flange 128 and remain between the edge/lip of the hole and the flange to prevent any fluid egress from the hole.

With continued reference to FIGS. 1A-1B, lander 100 includes a piston 112. Piston 112 have be formed from a piston head 112*a* affixed to a cylindrical piston shaft 112*b*. In various embodiments, the piston 112 may extend between an annular space formed between the inner cylinder 104 and outer cylinder 108. In various embodiments, piston 112 may have a piston head 112*a* sized to extend from the outer surface of inner cylinder 104 and the inner surface of outer cylinder 108. In various embodiments, piston head 112*a* may include one or more sealing features (as will be described below), such as gaskets, O-rings or other sealing features configured to sealably separate the annular space on a first side of the piston head 112*a* from a second side of piston head 112*a* (effectively creating two distinct chambers which can be pressurized to drive the piston up or down). In various embodiments, piston 112 may extend along the first axis between the inner cylinder 104 and outer cylinder 108. In various embodiments, piston shaft 112*b* may be a cylinder having a first end and a second end, with a piston head 112*a* disposed at the second end. In various embodiments, piston shaft 112*b* may include an inner diameter of approximately 2.5-3 inches. In various embodiments, piston shaft 112*b* may include an outer diameter of approximately 2.5-3 inches. In various embodiments, piston shaft 112*b* may be configured to translate along the first axis within the annular space. In various embodiments, the inner surface of piston shaft 112*b* may include one or more grooves extending the length of the shaft.

With continued reference to FIGS. 1A-1B, lander 100 includes a top sealing component 116. Top sealing component 116 may be a cylindrical components configured to threadably couple to the outer cylinder 108. Top sealing component 116 may include a central bore disposed therethrough axially aligned with the first axis. Said central bore may be configured to circumscribe the piston shaft 112*b* extending therethrough. Top sealing component 116 may be configured to remain fixed to the outer cylinder 108 and allow the piston 112 to translate within the central opening along the first axis. Top sealing component 116 may include a second threaded portion configured to couple to an annular component configured to close the annular space between the outer cylinder 108 and the piston 112. The central bore of the top sealing component 116 may be sized to receive a drill string therethrough and conduct the drill string through the piston 112 and to the inner cylinder 104 there below.

The top sealing component may include a pressure feed port 132 and accompanying channel configured to fluidly communicate the pressure feed port 132 to the annular space and the first side of the piston head 112*a*. Pressure feed port 132 may extend perpendicularly to the first axis such that it extends form the outer surface of the outer cylinder 108 to the inner surface of the piston shaft 112*b*. In various embodiments, top sealing component 116 may include a pressure release valve 136. Pressure release valve 136 may extend perpendicularly to the first axis and spaced opposite the pressure feed port 132. In various embodiments, the pressure release valve 136 may be in fluid communication with the annular space and the pressure feed port 132. In various embodiments, the pressure feed port 132 is configured to couple to a pressure source, such as a pump or other fluid source and selectively provide or extract fluid from the annular space formed between the outer cylinder 108 and the piston 112. In various embodiments, lander 100 may include a distinct feed port and release valve, or these components can be combined into a single two-way valve as described herein. This pressurization system can create a differential pressure between the two chambers on opposing sides of the piston 112 to drive the piston up/down, as desired, and at varying speeds.

With continued reference to FIGS. 1A-1B, lander 100 includes a lower sealing component 120. Lower sealing component 120 may be disposed at the lower ends of the outer cylinder 108 and inner cylinder 104. Lower sealing component 120 may threadably couple to outer cylinder 108 and have a central bore disposed therethrough, said central bore configured to circumscribe the inner cylinder 104 that extends therethrough. In various embodiments, a threaded coupling may be mechanically fastened to the outer cylinder, which threads on the lower sealing component 120. In various embodiments, the lower sealing component 120 may be affixed to the outer cylinder 108 itself, via threads, mechanical fasteners, or chemical adhesives, or a combination thereof. Lower sealing component 120 may be configured to seal the annular space between the outer cylinder 108 and inner cylinder 104, forming a second annular space between the second side of the piston head 112*a*. Lower sealing component 120 may include at least one of a pressure feed port and vent, as will be described herein below.

With continued reference to FIGS. 1A-1B, lander 100 includes a driver coupling 124. Driver coupling 124 may be releasably coupled to the opposite end of piston shaft 112*b* than the piston head 112*a*. Driver coupling 124 may include a threaded portion configured to threadably couple to said piston shaft 112*b*. In various embodiments, driver coupling 124 may be generally cylindrical, having a central bore extending therethrough, the central bore of the driver coupling 124 in communication with the central bore of the top sealing component 116 and the inner surface of piston 112 and inner cylinder 104. Opposite the threaded portion, driver coupling 124 may include a quick-connect portion configured to releasably couple to a driver assembly, which will be described in further detail below. In various embodiments the quick-connect portion may include tabs, levers, latches or other manipulatable controls configured to secure and release said driver assembly to the driver coupling 124 via rotatably or moveable cams that engage the surface of the quick-connect portion of the driver assembly 140.

Figure 2:
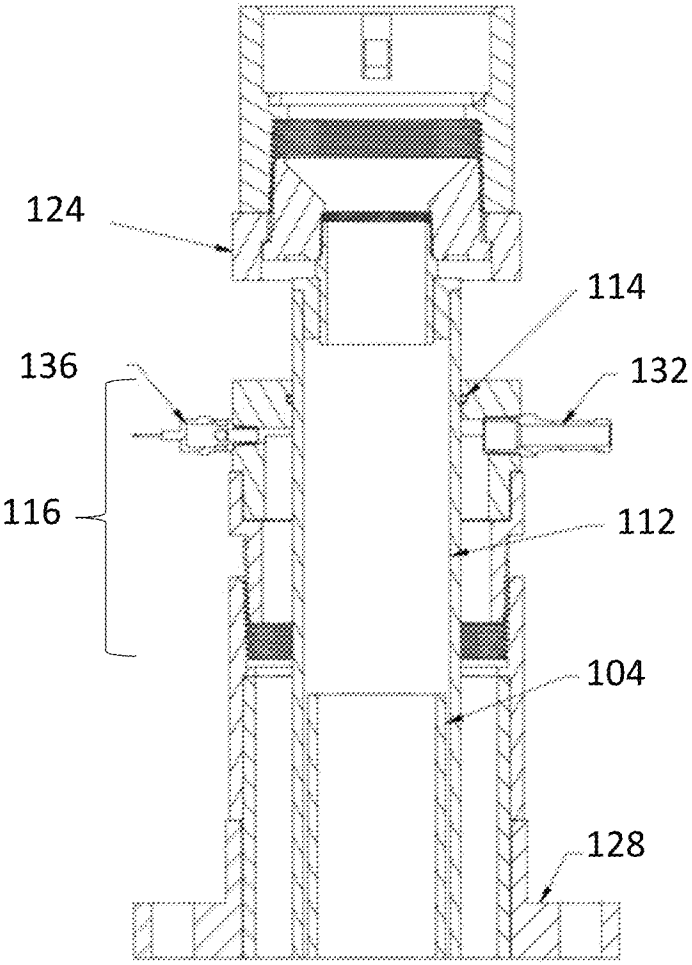
FIG. 2 is a cross-sectional view of an upper portion of the annular piston pile driver in a contracted state in accordance with the disclosed subject matter.

Referring now to FIG. 2, a detail cross-sectional view of an upper section of the lander 100 is shown in a slightly extended state. In various embodiments, as shown, the piston 112 may travel to a lower position, wherein a bottom portion of the driver coupling 124 is spaced from a top portion of top sealing component 116. As can be readily seen from FIG. 2, top sealing component 116 may be threadably engaged with the outer cylinder 108. The driver coupling 124, top sealing component 116, piston 112 and inner cylinder 104 forms a continuous axial space extending through the entirety of the lander 100 to allow a drill string to extend therethrough, with a drill head extending past a bottom portion of the lander 100. Additionally, the upper end of inner cylinder 104 is shown extending proximate and inside the upper end of outer cylinder 108 and within piston 112. Piston 112 may be configured to translate up/down within the annular space between outer cylinder 108 and inner cylinder 104 and spaced from both cylinders. Alternatively, or additionally, the piston 112 may contact one or both of the inner cylinder and outer cylinder the entire distance of travel of the piston 112 or a portion thereof. The inner cylinder 104 may have one or more protruding features on the outer surface to mate into a matching groove on the inner surface of the piston 112 such that the piston 112 can slide linearly but is constrained rotationally.

Further, as shown in FIG. 2, there may be a piston seal 114 between the top sealing component 116 and the piston shaft 112*b* of piston 112. Piston seal 114 may be an O-ring, gasket or other rubber/compliant component configured to seat within a channel circumscribing the central bore of top sealing component 116. Further, driver coupling 124 may include a threadable portion configured to a cylindrical portion of the drive coupling 124 to the piston shaft 112*b*.

Figure 3:
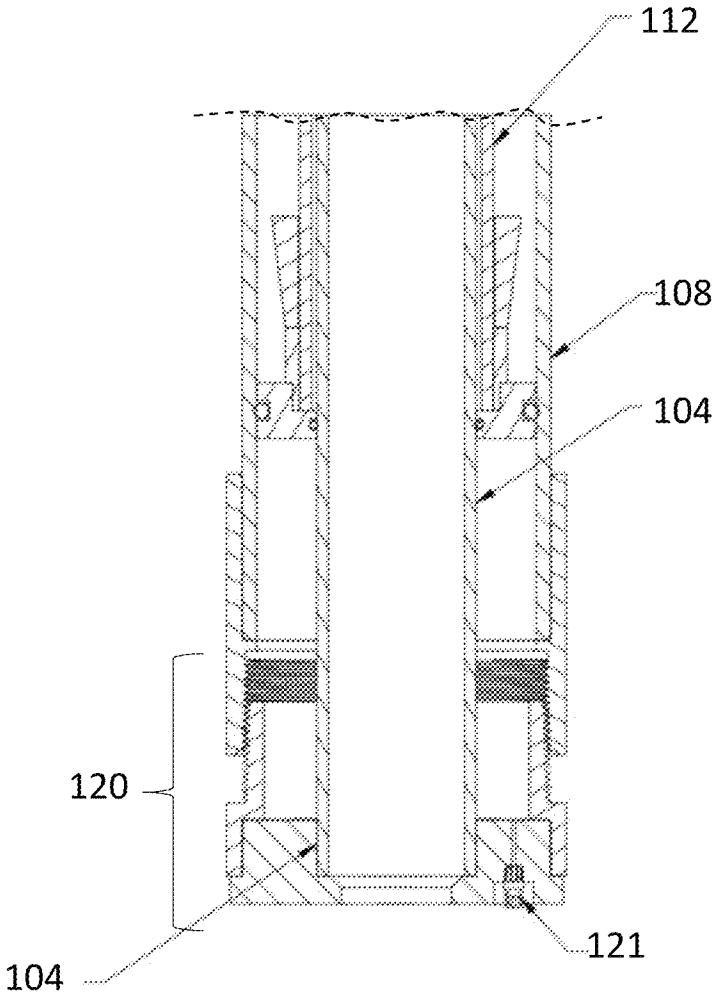
FIG. 3 is a cross-sectional view of a lower portion of the annular piston pile driver in a contracted state in accordance with the disclosed subject matter.

Referring now to FIG. 3, a lower portion of lander 100 is shown in detailed cross-sectional view. The lower portion of outer cylinder 108 is threadably engaged to a complementary threaded portion disposed on the lower sealing component 120. Said lower sealing component 120 is an annular component that accepts the lower end of the inner cylinder 104 through a central bore, and couples to the outer cylinder 108. The lower sealing component 120 forms a sealed lower annual space between the outer cylinder, inner cylinder and lower surface of the piston head 112*a*. In various embodiments, lower sealing component 120 may include a centrally-disposed shoulder configured to retain the lower end of the inner cylinder 104 thereon, thereby fixedly maintaining the inner cylinder 104 relative position to the outer cylinder 108. Lower sealing component 120 may include at least one of a pressure feed port and vent 121. For the sake of this disclosure, this component will be referred to as valve 121. Valve 121 may extend from a lower face of the lower sealing component 120 through to the lower annular space, thereby allowing fluid communication from the annular space to a pressure source and/or fluid line for selectively providing or extracting fluid from the lower annular space. In various embodiments, valve 121 may be a two-way valve configured to close the port unless fluid is forced therethrough in one direction, for example, from a pressure source into the annular space or from the annular space to a fluid line, thereby extracting the fluid and forcing the piston 112 downward.

Figure 4:
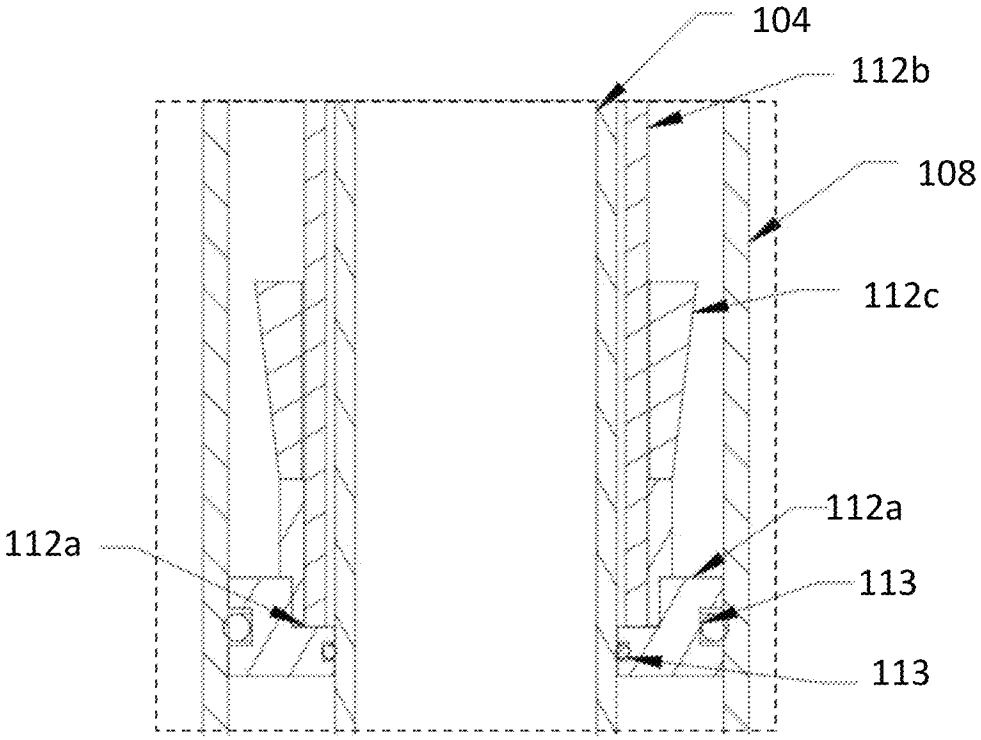
FIG. 4 is a detail cross-sectional view of the piston of the annular piston pile driver in accordance with the disclosed subject matter.

Referring now to FIG. 4, the lower end of piston 112 is shown in the annular space between the inner cylinder 104 and the outer cylinder 108, in a detailed cross-sectional view. The lower end of piston 112 may include the piston head 112*a* coupled to the tubular piston shaft 112*b*. Piston head 112*a* may abut both the inner surface of the outer cylinder 108 and outer surface of inner cylinder 104. Piston head 112*a* may include a stepped cross-section, having a relatively thinner portion proximate a central opening and a thicker portion radial outward from the thinner portion. In various embodiments, the piston head 112*a* may be countersunk. In various embodiments, piston head 112*a* may include an inner seal 113 and outer seal 113. Inner seal 113 may be disposed in a channel within the piston head 112*a* and abutting the inner cylinder 104. Outer seal 113 may be oppositely disposed in the radially-outward face of the piston head 112*a* within a channel circumscribing it. The outer seal 113 may be disposed between the piston head 112*a* and the outer cylinder 108. The piston head 112*a* thereby forms a first annular space define by the upper face of the piston head, the outer cylinder and the piston shaft, and a second annular space defined by the lower face of the piston head, the outer cylinder and the inner cylinder. Fluid can be selectively provided to either of the first or second annular spaces to force the piston to move downward or upward respectively. In another example, fluid can selectively be provided or extracted from only the first or second annular space in order to force the piston upward or downward. For example, fluid may be provided under pressure to the first annular space, thereby forcing the piston downward. Conversely, fluid can then be forcibly extracted from the same first annular space through the pressure relief valve or the pressure feed port under a vacuum, thereby reducing the pressure in the first annular space and forcing the piston back upward. Alternatively, the fluid can be selectively provided or extracted from the lower annular space, such that under a vacuum, the lower annular space reduces the pressure below the piston head 112*a* forcing the piston downward, and conversely fluid under pressure can be provided to the lower annular space forcing the piston 112 upward. In this manner, fluid can selectively be provided to one or both of the annular spaces in order to control the linear motion of the piston within the lander 100.

With continued reference to FIG. 4, piston 112 may include a travel limiter 112*c*. Travel limiter 112*c* may be a cylindrical or tubular component circumscribing the lower end of the piston 112 proximate the piston head 112*a*. Travel limiter 112*c* may be include a conical or frustoconical section radiating upward and outward from the piston shaft 112*b*, the upper portion of the frustoconical section of the travel limiter 112*c* is configured to abut the upper sealing component 116, thereby preventing the piston 112 from travelling past the upper sealing component 116. In various embodiments, the travel limiter 112*c* may be spaced from the piston head 112*a* such that the travel limiter 112*c* abuts the upper sealing component 116 while retaining the piston head 112*a* sealed against the inner cylinder 104 and outer cylinder 108. Travel limiter 112*c* is fixed to piston head 112*a* such that it travels within the annular space with the piston 112.

Figure 5A:
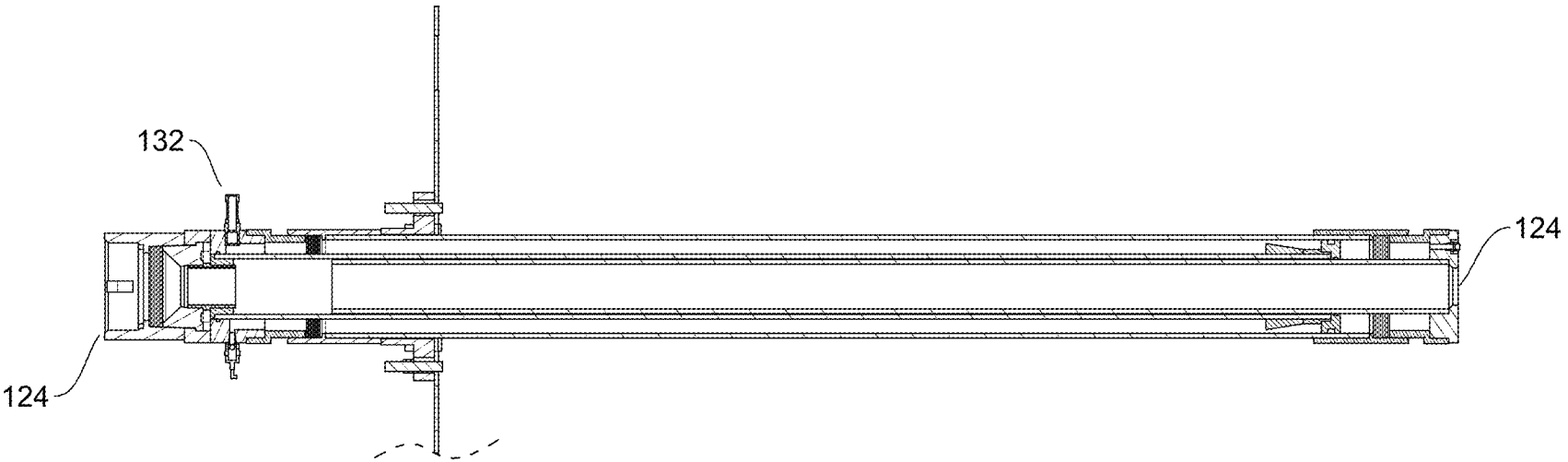
FIGS. 5A-5B are cross-sectional views of the annular piston pile driver in a contracted and expanded state, respectively, in accordance with the disclosed subject matter.
Figure 5B:
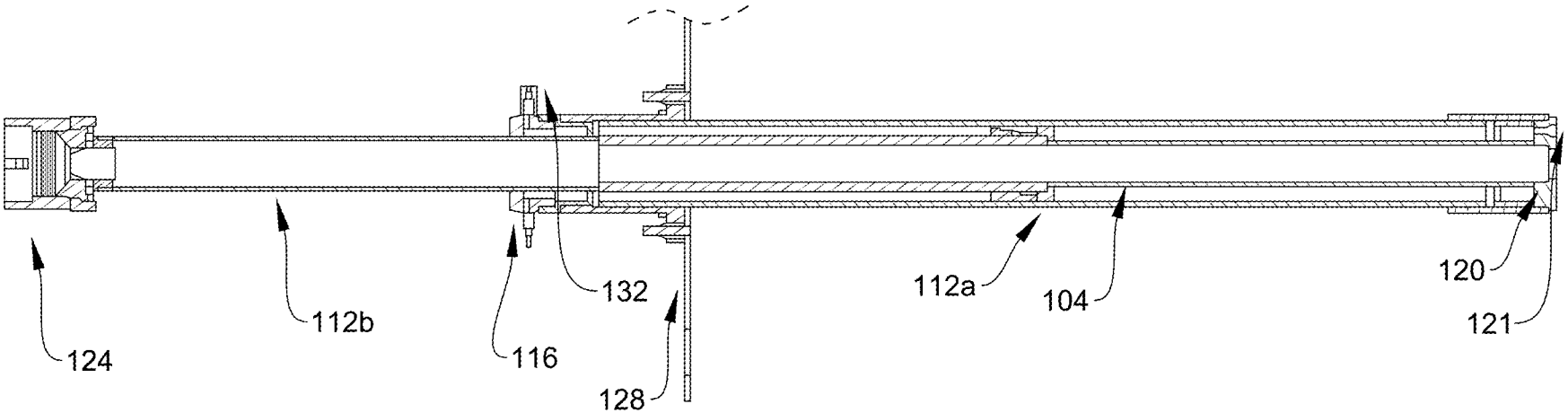
Figure 5C:
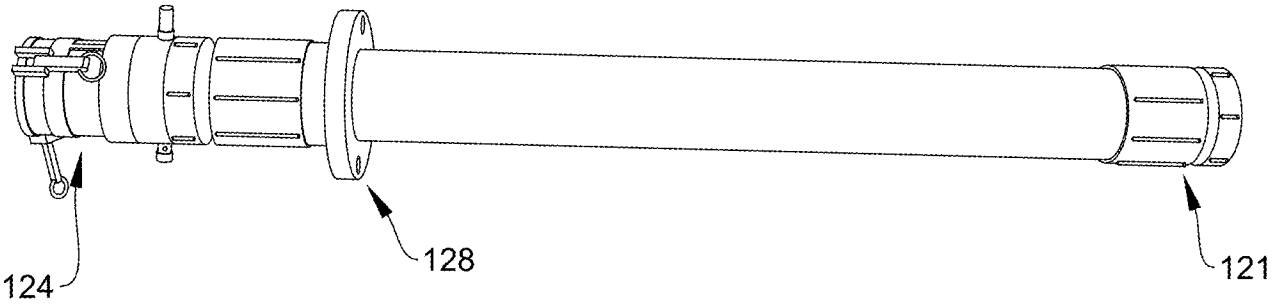
FIGS. 5C-5D are side views of the annular piston pile driver in a contracted and expanded state, respectively, in accordance with the disclosed subject matter.
Figure 5D:
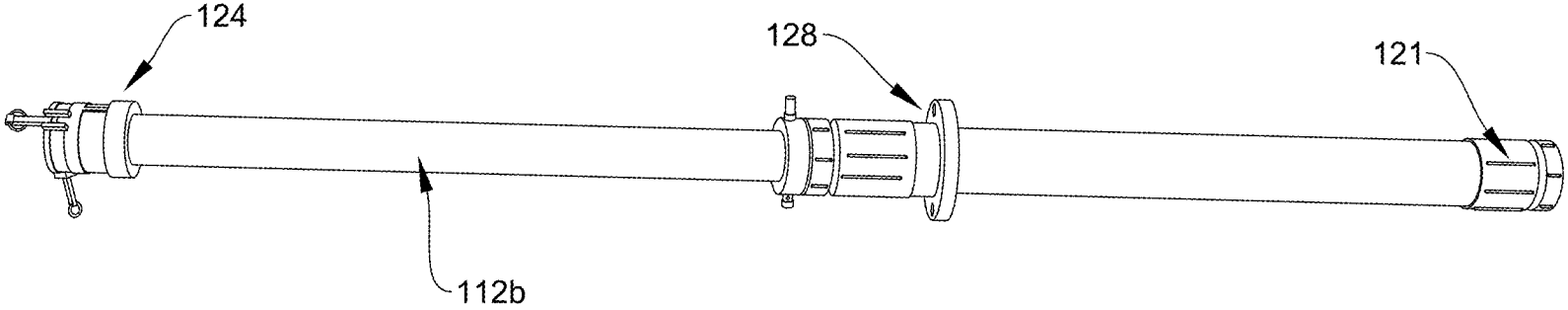

Referring now to FIGS. 5A-5D, the annular piston pile driver (or "lander") is shown in a contracted (or lowered position) in FIGS. 5A and 5C; and in an extended (or upper position) in FIGS. 5B and 5D. The annular piston pile driver 100 is configured to control the rotation and linear motion of a drill string between a certain travel distance, said travel distance defined by the extreme lower and upper positions of the piston 112 in the annular piston pile driver 100. In a lowered position (as shown in FIGS. 5A and 5C) the piston 112 is at its lowest position, the driver coupling 124 being bottomed out against the top sealing component 116, said contact between the driver coupling 124 and the top sealing component 116 limiting the piston to its lower-most position.

Conversely, in its extended or upper position (shown in FIGS. 5B and 5D) shows the piston at some point during its travel between its extreme highest position and lowest position. As can be seen in the cross-sectional view of FIG. 5B, the piston head 112*a* is at a midpoint within the length of the inner and outer cylinders 104, 108. It can readily seen that the piston 112 is configured to slide or translate within the annular space between the inner cylinder 104 and outer cylinder 108, linearly constrained only by the geometrical interfaces of the driver coupling 124 with the top sealing component 116 (on the downward pass) and the travel limiter 112*c* and the top sealing component 120.

Figure 6A:
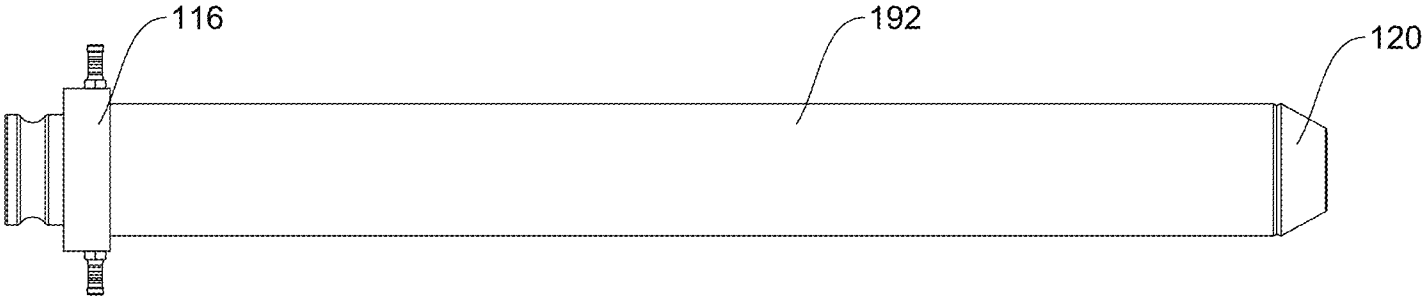
FIGS. 6A-6D are side views and cross-sectional side views of an embodiment of the annular piston pile driver having an outer casing, in accordance with the disclosed subject matter.
Figure 6B:
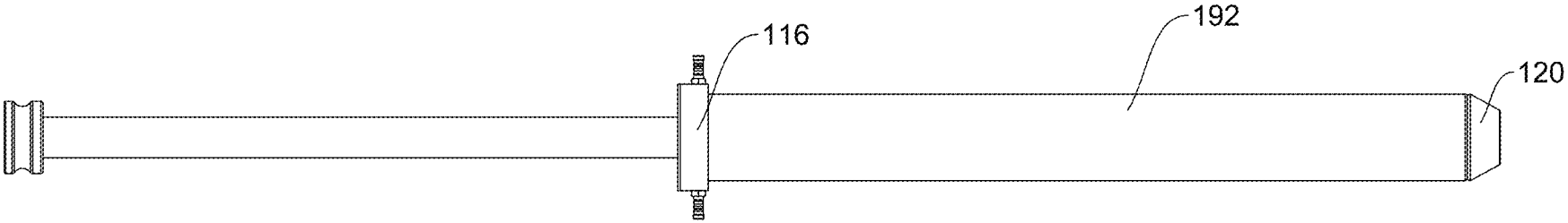
Figure 6C:
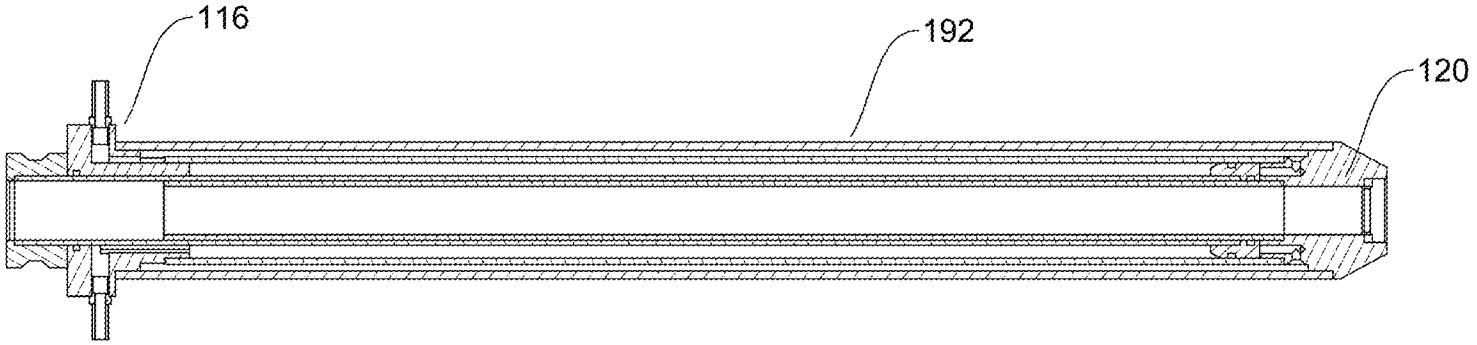
Figure 6D:
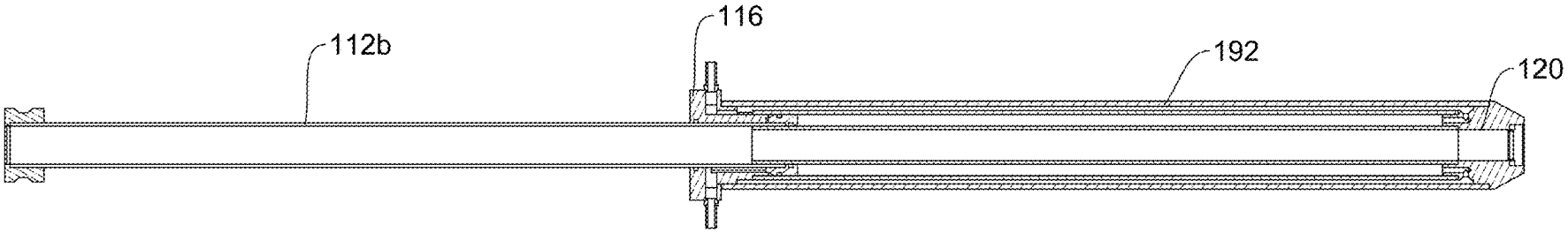

Referring now to FIGS. 6A and 6B, annular piston pile driver 100 is shown with an outer casing 192 circumscribing the outer cylinder 108. Outer casing 192 may be concentrically disposed about the first axis, and extending form the top sealing component 116 and lower sealing component 120. Outer casing 192 may be spaced from the outer surface of outer cylinder 108 forming an annular space between the outer cylinder 108 and the outer casing 192. The annular space between outer cylinder 108 and outer casing 192 may be in fluid communication with valve 121 and pressure feed 132. The annular space between outer cylinder 108 and outer casing 192 may be configured to conduct fluid, be it pneumatic or hydraulic fluid, to valve 121 may be configured to selective introduce fluid into the lower annular space in communication with the lower face of the piston 112*a* in order to force the piston upward. Alternatively or additionally, the annular space between the outer cylinder 108 and outer casing 192 may be configured to conduct fluid out of valve 121 and through the pressure release valve 136, thereby forcing the piston downward. Outer casing 192 may be configured to shield a fluid conduit disposed therein to the valve 121, in various embodiments. Outer casing 192 may be formed from polyvinyl chloride (PVC), aluminum, steel, or other materials known in the art. Outer casing 192 may be configured to threadably engage the top sealing component 116 or lower sealing component 120. In various embodiments, the outer casing 192 may be configured to press fit with said component, chemically adhered to said components, or coupled via mechanical fasteners. One or more fluid lines may be disposed within the annular space formed by the outer casing 192, such that the outer casing 192 shields the fluid line within the borehole. In various embodiments, outer casing 192 may be configured to abut the sides of the borehole to which it is inserted.

Figure 6E:
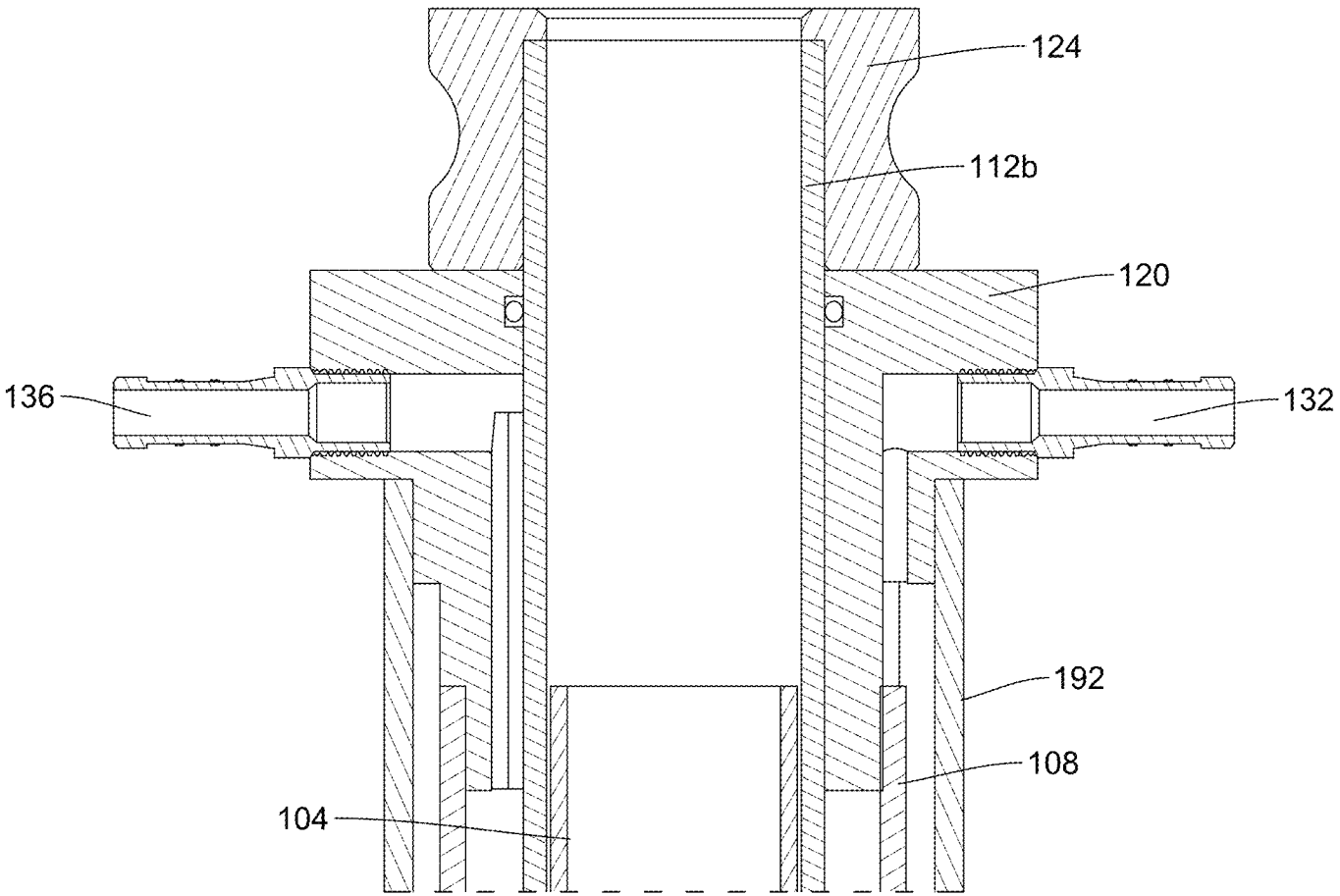
FIGS. 6E-6F are side cross-sectional views of a top sealing component and lower sealing component of an annular piston pile driver having an outer casing, in accordance with the disclosed subject matter.

Referring now to FIG. 6E, an upper portion of the annular piston pile driver 100 having an outer casing 192 is shown in cross-sectional view. As described above in reference to FIG. 2, top sealing component 116 may include a pressure feed 132 and pressure release valve 136. As shown in FIG. 6E, an annular space is formed between outer cylinder 108 and outer casing 192, said annular space in fluid communication with the pressure feed 132 and valve 121 (not shown). The annular space between outer cylinder 108 and outer casing 192 may be configured to conduct fluid between pressure feed 132 and valve 121, thereby forming a loop between the upper and lower faces of the piston head 112*a*. Outer casing 192 may be press fit with top sealing component 116 and glued thereto. Outer casing 192 may be configured to abut a shoulder in top sealing component 116 under the pressure feed 132—thereby forming a registration feature to identify full seating.

Figure 6F:
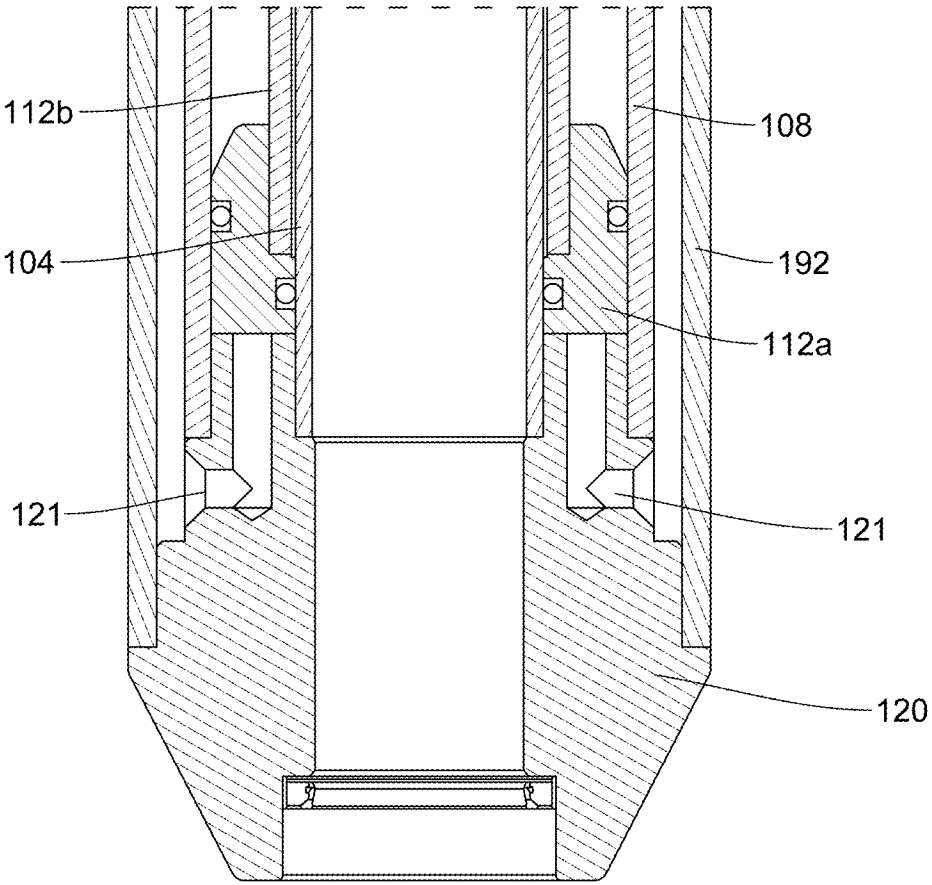

Referring now to FIG. 6F, a lower portion of an annular piston pile driver 100 having an outer casing 192 is shown in cross sectional view. In various embodiments, lower sealing component 120 may include a series of shoulders configured to retain said outer casing 192 thereon. Lower sealing component 120 may be configured to simultaneously retain inner cylinder 104, outer cylinder 108, and outer casing 192. In various embodiments, outer casing 192 may form an annular space between outer cylinder 108. Lower sealing component 120 as described above, include valve 121, or as shown in FIG. 6F, a plurality of valves 121, such as two valves. In various embodiments, as described above, the annular space between outer casing 192 and outer cylinder 108 may be configured to conduct fluid between valve 121 and the pressure feeds or pressure relief valves. Fluid may be conducted out of or into the annular space and in fluid communication with the piston head in order to facilitate movement of the piston within the annular piston pile driver. In various embodiments, lower sealing component 120 may be gradually decreasing in outer diameter as it extends lower, such that the lowest terminal end of the lower sealing component 120 is lesser in diameter than the upper terminal end. For example, and without limitation, the lower sealing component 120 may include a frustoconical shape with the apex pointing downward.

Referring now to FIGS. 7A-7D are various cross-sectional views of a driver assembly of an annular piston pile driver. Driver assembly 140 may be configured to control the rotation (revolution speed, torque, and or direction) of a drill string within the annular piston pile driver. Driver assembly 140 is configured to be connected and disconnected from a topside of a drill string for the addition of further drill string lengths in order to extend the borehole downward, all while controlling the rotation of the drill string. Driver assembly 140 further is configured to provide inputs and outputs for fluid flow for the drill string itself.

Driver assembly 140 may include a housing 144. Housing 144 may be generally cylindrical or radially symmetrical. Housing 144 may have an upper end and a lower end, defining a length therebetween. Housing 144 may be axially aligned with the first axis, and concentrically aligned with the annular piston pile driver 100. Housing 144 may include a cavity disposed at its center, the cavity extending through the housing from the upper end to the lower end. The cavity of housing 144 may include a plurality of shoulders or concentric sections of varying diameter to accommodate the internal rotating components described hereinbelow. Housing 144 may have a conical or frustoconical portion disposed at the upper end, the apex of the frustoconical section terminating in an opening. Housing 144 may include a main rotary shaft 148 disposed in the cavity. Main rotary shaft 148 may be disposed about the first axis and configured to rotate there around. Main rotary shaft 148 be complementary shaped with the cavity such that the main rotary shaft 148 cannot translate along the first axis within the housing 144. Main rotary shaft 148 may be configured to rotate within the stationary housing 144. Main rotary shaft 148 may include any number of channels circumscribing portions thereof configured to seat sealing components therein. Main rotary shaft 148 may include channels or openings configured to facilitate fluid flow from an input disposed in the housing 144 to the drill string (to be described hereinbelow). In various embodiments, main rotary shaft 148 includes a threaded portion 172 configured to matingly couple with a drill string. Main rotary shaft 148 may be configured to rotate in the same direction as the threads, such that rotation of the main rotary shaft 148 cannot unthread the main rotary shaft 148 from the drill string (184).

Figure 7A:
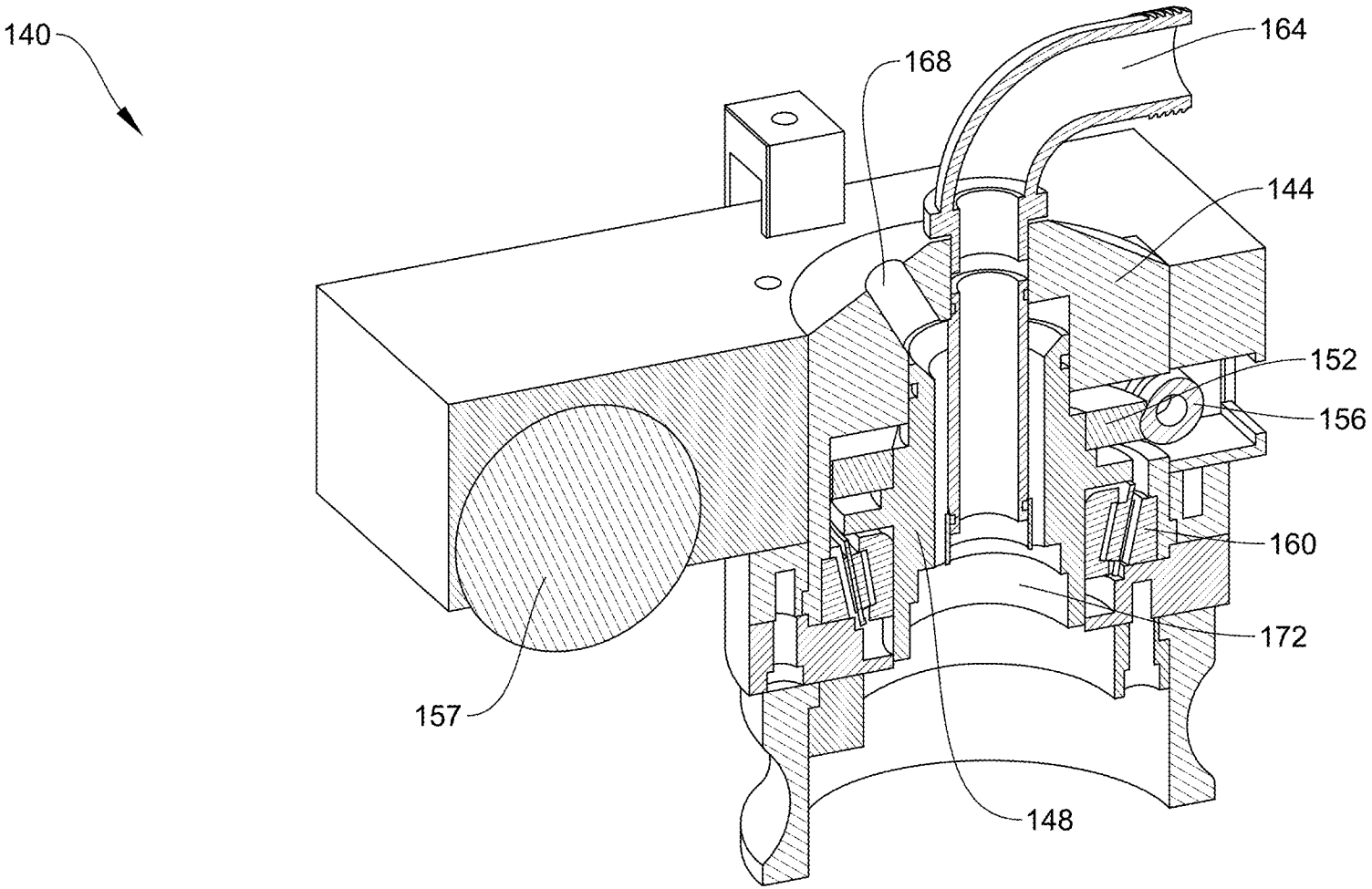
FIG. 7A is a perspective cross-sectional view of a driver assembly configured to be coupled to the annular piston pile driver in accordance with the disclosed subject matter.
Figure 7B:
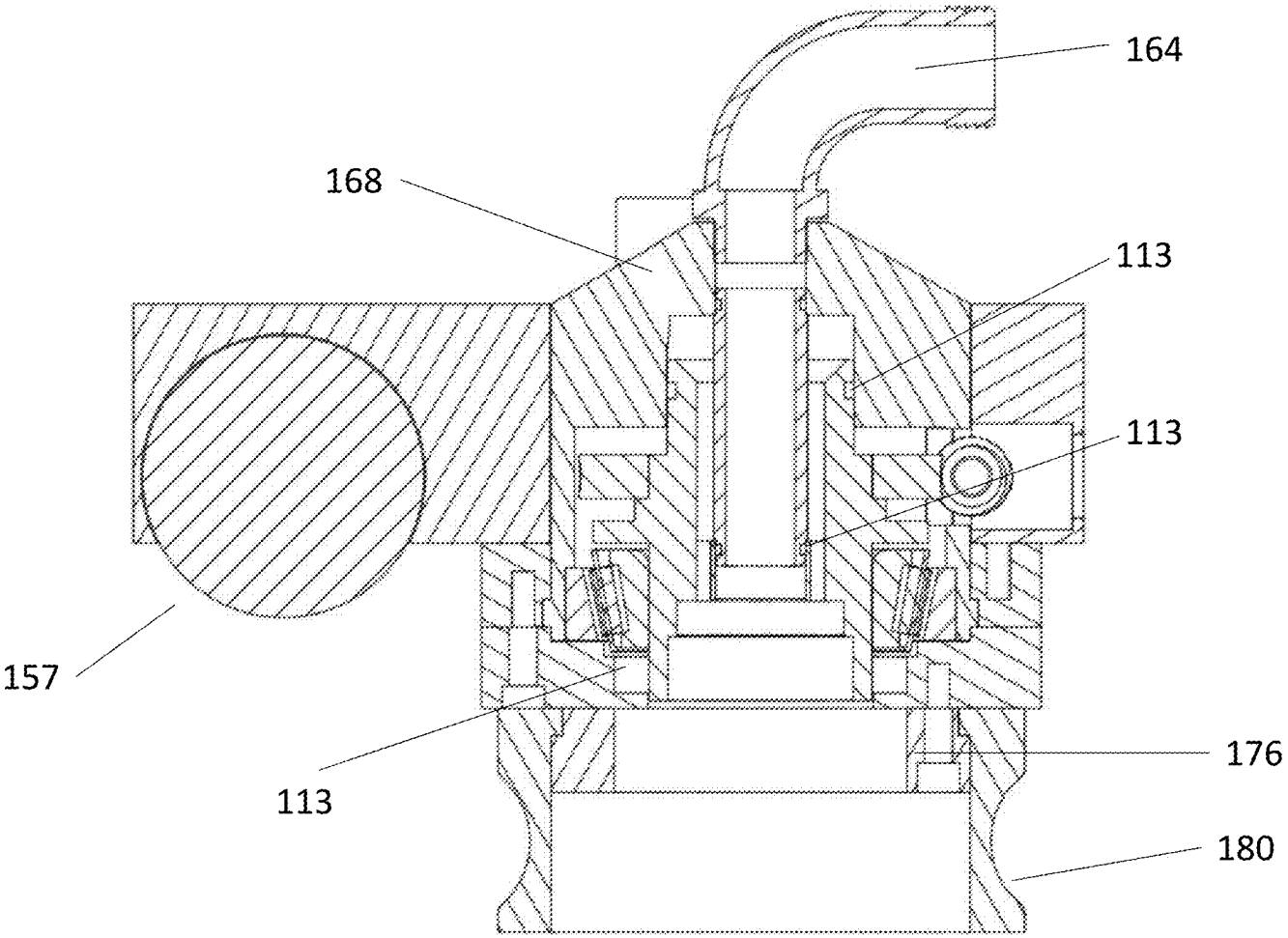
FIG. 7B is a cross-sectional views of the driver assembly in accordance with the disclosed subject matter.

With continued reference to FIGS. 7A and 7B, driver assembly 140 includes a main rotor gear 152. Main rotor gear 152 may be fixedly coupled to main rotary shaft 148. Main rotor gear 152 may be unitarily constructed with main rotary shaft 148. In various embodiments, main rotor gear 152 may be press fit onto main rotary shaft 148 or joined thereto by complementary geometry, such as with slots and complementary bosses between the two components. Main rotor gear 152 may circumscribe the main rotary shaft 152 and configured to rotate about the first axis. Main rotor gear 152 may be configured to rotate the main rotary shaft 148 under the influence of one or more driving gears, such as a worm gear 156. Worm gear 156 may be disposed proximate the main rotor gear 152 and enmeshed therewith. For example and without limitation, worm gear 156 may be configured to rotate about an axis perpendicular to the first axis such that the worm gear is disposed within the plane of the main rotor gear 148. In various embodiments, the worm gear and the main rotor gear may have a gear ratio of 80:1, such that 80 revolutions of the worm gear rotate the main rotor gear a single full revolution. This disclosure does not seek to limit the gear ratio of the driving gear (such as the worm gear 156) and the main rotor gear 152. In various embodiments, the drive train (made up of the series of gears) may be configured for a high torque gear ratio or a high speed gear ratio. This disclosure does not seek to limit the gear ratio of any two components in the drive train.

For example, and without limitation, the worm gear 156 may be in communication with a motor 157, such as an electric motor having a rotor shaft. Motor 157 may be coupled to the worm gear 156 via one or more pulleys, gears/gearboxes, or other transmission systems. In various embodiments, motor 157 may be disposed perpendicular to the first axis, such the rotor of the motor 157 rotates in a plane perpendicular to the plane of rotation of the main rotary shaft 148. Motor 157 may be disposed within a motor housing configured to seatably couple with housing 144, such as encapsulating a portion of housing 144. Motor housing may also house the worm gear 156 and any transmission components as described herein. In various embodiments, the motor housing may be unitarily constructed with the housing 144 or assembled via mechanical fasteners.

With continued reference to FIGS. 7A and 7B, driver assembly 140 includes a roller bearing 160. Roller bearing 160 may be configured to circumscribe the main rotary shaft 148 and seat within a channel or shoulder of housing 144. Roller bearing 160 is configured to support the main rotary shaft 148 during its rotations within housing 144. Roller bearing 160 may be a tapered roller bearing having extending from a relatively larger diameter at an upper section of the roller bearing 160 and taper down to a relatively lesser diameter at a lower section of the roller bearing 160. Roller bearing 160 may include any number of ball bearings captured between complementary rotatable sections, or cylindrical roller bearings also captured therebetween.

With continued reference to FIGS. 7A-7B, driver assembly 140 includes an adapter plate 176. Adapter plate 176 may be disposed at a lower portion of the driver assembly 140. Said adapter plate 176 may include an annular shape with a central bore disposed therethrough, said central bore in communication with the central bore of the main rotary shaft 148. Adapter plate 176 may be configured to provide a mounting surface of quick connector 180. In various embodiments, the quick connector 180 may be configured to matingly couple the driver assembly 140 to the driver coupling 124. In various embodiments, quick connector 180 may be a generally cylindrical component coupled to the lower surface of the adapter plate 176 and driver assembly 140. Quick connector 180 may include a central bore in fluid communication with the central bore of the adapter plate 176 and the main rotary shaft 148. Quick connector 180 may include a tapered waist (or midpoint) configured to complement the latching portion of driver coupling 124. For example and without limitation, the latching portions of driver coupling 124 may be fit within the tapered waist of quick connector 180 and retain the driver assembly 140 to the annular piston pile driver 100. In various embodiments, quick connector 180 may seat within the driver coupling 124 such that the driver coupling 124 circumscribes the quick connector 180.

Figure 7C:
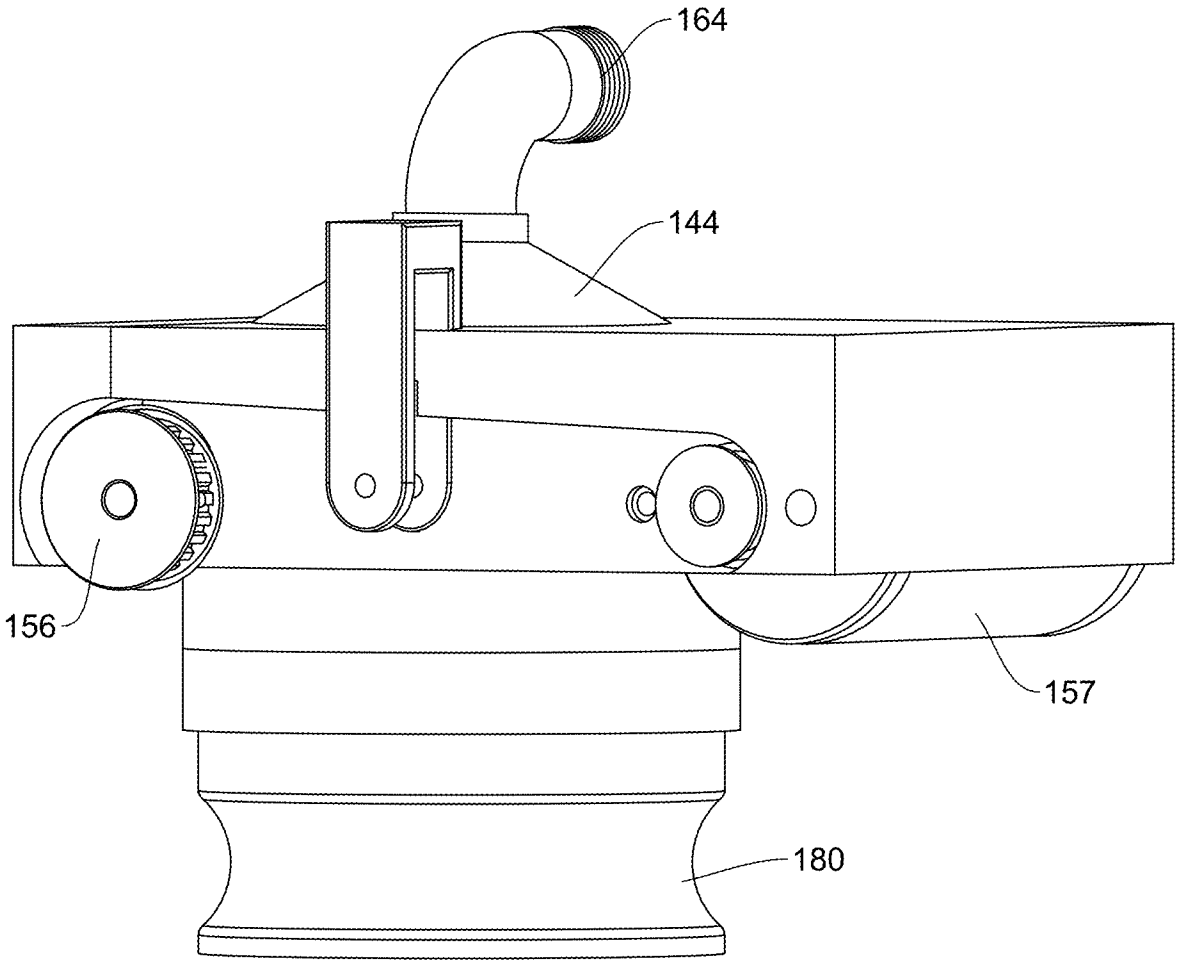
FIG. 7C is a perspective view of a driver assembly in accordance with the disclosed subject matter.

Referring now to FIG. 7C, a perspective view of the driver assembly 140 according to the disclosed subject matter. Driver assembly 140 includes housing 144. Housing 144 may be generally cylindrical, with a frustoconical upper section terminating in outflow 164. Outflow 164 may extend axially through the housing 144 as described herein, and in fluid communication with the central bore of the drill string. Driver assembly 140 may be releasably fixed to a motor housing, which may be configured to seatably affix to housing 144 by a press fit or mechanical fasteners. Motor housing may provide support for motor 157, and worm screw 156. For clarity, the belt or pulley has been removed from the perspective view shown in FIG. 7C. Motor housing may include a tensioner disposed between the motor 157 and the worm screw 156, providing adjustable tension to the belt rotatably coupled to each thereof. Tensioner may be configured to translate axially relative to the driver assembly 140 in order to selectively tension the belt or toothed belt. Driver assembly 140 is shown with quick connector 180 disposed at a lower portion thereof, opposite the outflow 164. Quick connector 180 may be formed by a radially symmetrical body having a waist circumscribing the outer portion thereof. Said waist of the quick connector 180 may be configured to couple to driver coupling 124 as described herein via rotatably engageable slotting into the waist.

Figure 7D:
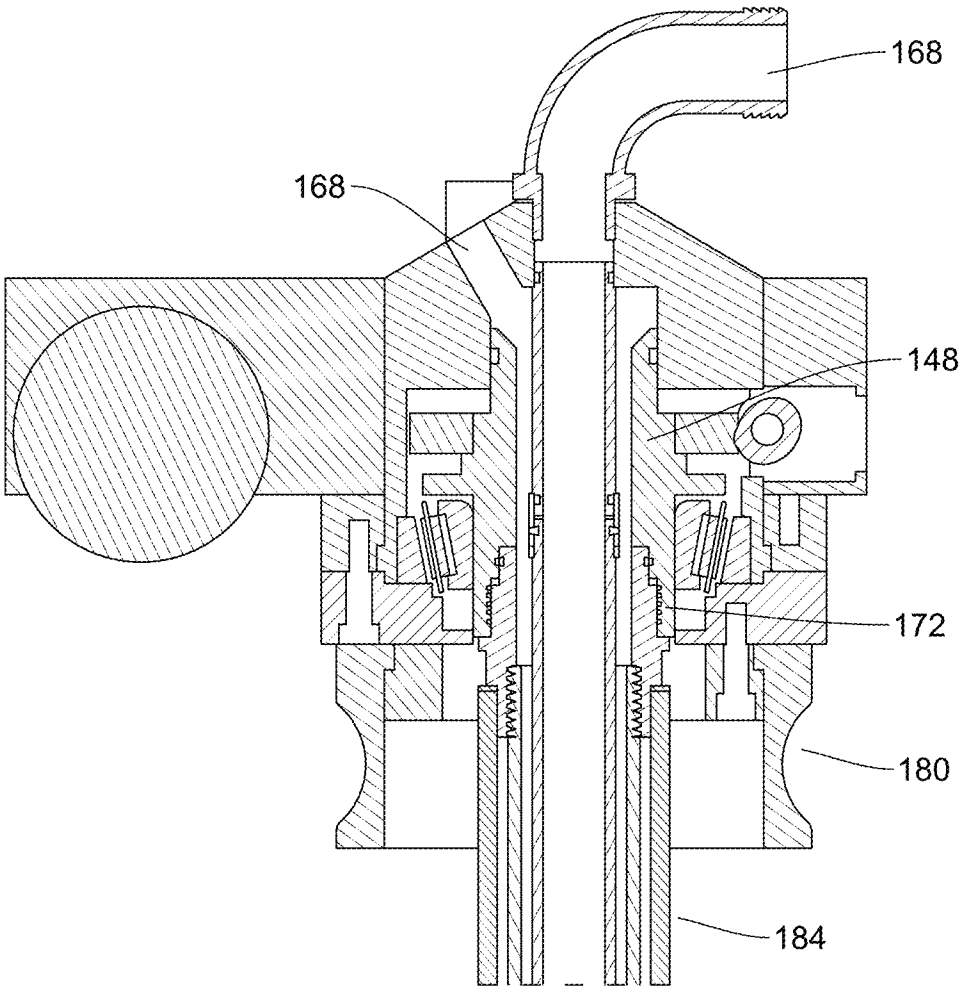
FIG. 7D is a cross-sectional view of the driver assembly coupled to a drill string in accordance with the disclosed subject matter.
Figure 7E:
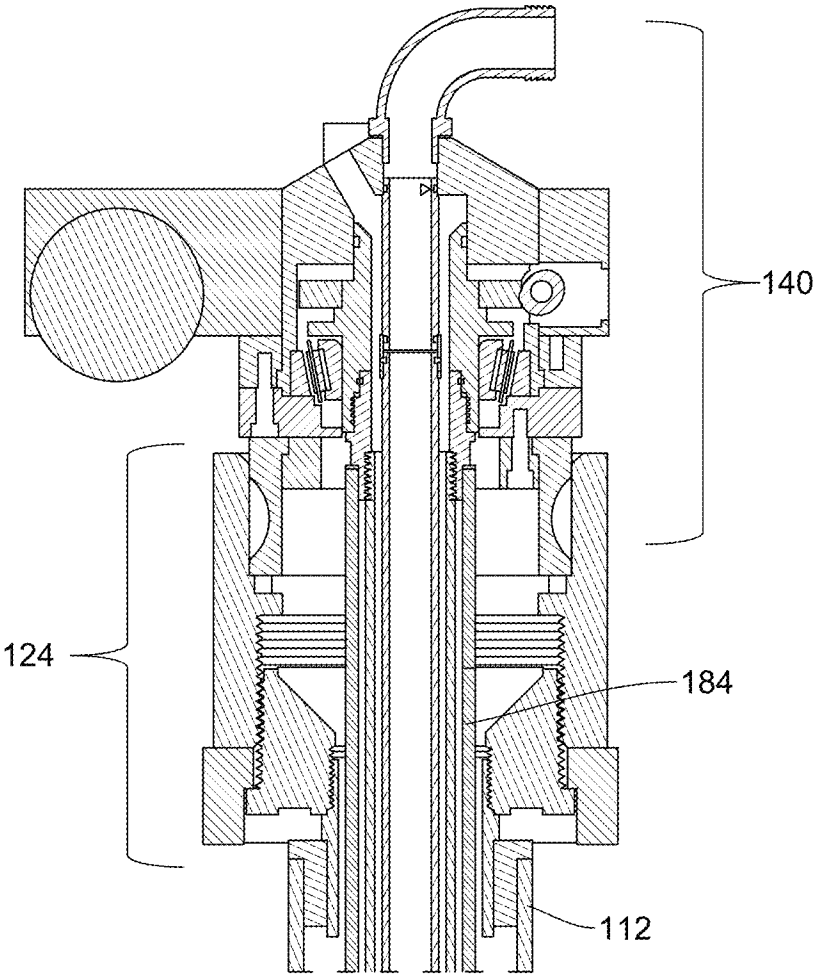
FIG. 7E is a cross-sectional view of the driver assembly and drill string coupled to the piston of the annual piston pile driver in accordance with the disclosed subject matter.

Referring now to FIGS. 7D and 7E, driver assembly 140 is shown in cross-sectional views coupled to a drill string and further coupled to a drill string and annular piston pile driver, respectively. Specifically in FIG. 7D, drill string 184 is threadably coupled to the threaded portion 172 of main rotary shaft 148. Drill string 184 may be coupled to driver assembly 140 through the threaded portion 172 at the opposite end of the drill string from the drill head. That is to say that the driver assembly 140 is disposed at a first or topmost section of drill string 184 than the drill head disposed at the bottom of the borehole. Referring specifically to FIG. 7E, drill string 184 is shown coupled to the driver assembly 140 and extending through the annular piston pile driver 100. In FIG. 7E the piston 112 of annular piston pile driver 100 is coupled to the driver assembly 140 by quick connector 180 and driver coupling 124. The drill string 184 is configured to rotate within the annular piston pile driver 100 as driven by the driver assembly 140.

With continued reference to FIGS. 7D and 7E, driver assembly 140 includes an outflow 164. Outflow 164 may be a tubular section in fluid communication with the central bore within main rotary housing 148. Outflow 164 may be configured to conduct cuttings and fluid from the bottom of the borehole to the surface of the earth or a vessel in order to remove the cuttings and fluid from the cutting surface of the borehole.

With continued reference to FIGS. 7D and 7E, driver assembly 140 includes a feed port 168 disposed within the housing 144. Feed port 168 may be disposed within the housing 144 at an angle and adjacent to the outflow 164. Feed port 168 may be in fluid communication with an annular space formed between the inner surface of the main rotary shaft 148 and outer surface of the outflow 164 and configured to provide high pressure fluid to the drill string. The annular space formed between the inner surface of the main rotary shaft 148 and the outer surface of the outflow 164 may extend in fluid communication with the drill string's annular space configured to receive the high pressure fluid. Said high pressure fluid may be conducted down the drill string and ejected out of the drill head to cut away material from the bottom of the borehole.

Figure 8:
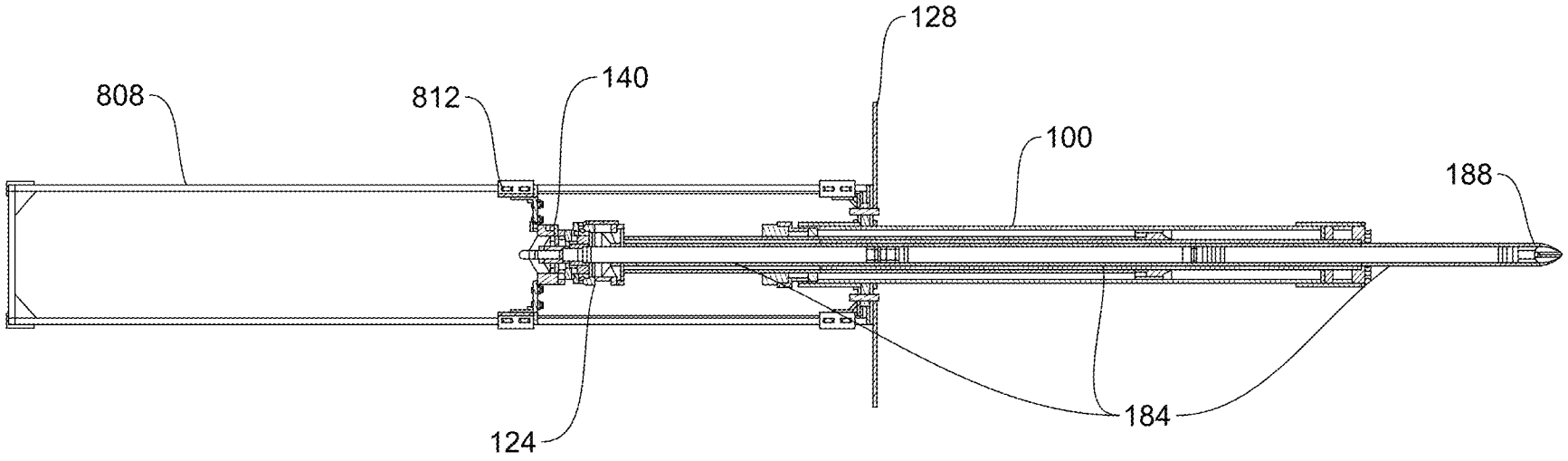
FIG. 8 is a cross-sectional view of a system for drilling boreholes utilizing the annular piston pile driver in accordance with the disclosed subject matter.

Referring now to FIG. 8, a system 800 for drilling a borehole and extending a drill string in accordance with the disclosed subject is shown in cross-sectional view. System 800 includes annular piston pile driver 100 and driver assembly 140 coupled thereto as describe above. System 800 includes a series of discrete sections of drill string 184 extending from the drive assembly 140 to the drill head disposed at the opposite end (a proximal end of a first drill sting coupled to the distal end of a second drill head disposed above the first drill string). System 800 includes a frame 804. Frame 804 may be coupled to the mounting flange 128. Frame 804 may extend along the first axis from a lower end coupled to the mounting flange 128 to an upper end. Frame 804 may include at least one member 808 extending along the first axis. As shown in FIG. 8, frame 804 may include a plurality of parallel members 808. The cross-sectional view shows two parallel members 808, one of ordinary skill in the art would appreciate that there are four parallel members 808 forming a rectilinear frame 804.

Frame 804 may further be formed from at least one cross member extending perpendicular to the members 808, thereby constraining the members 808 in the plane perpendicular to the first axis. Frame 804 may further include a sliding carriage 812. Sliding carriage 812 may be translatably coupled to the members 808 and fixedly coupled to the driver assembly 140. Sliding carriage 812 may be fixed to driver assembly 140, and therefore coupled to drill string 184. As the drill string 184 drills the borehole deeper, the driver assembly 140 lowers towards the annular piston pile driver 100 towards the surface of the ground at 128. As the driver assembly 140 lowers, the sliding carriage 812 lowers at the same rate. In various embodiments, sliding carriage 812 may be configured to prevent rotation of the driver assembly 140 in response to the rotation of the drill string 184. Sliding carriage 812 may be fixed to the frame 804 which is coupled to the mounting flange 128.

As shown in FIG. 8, system 800 includes a drill string 184 as described herein. Drill string 184 may be a length of drill string configured to be connected in an arbitrarily long series of lengths of drill string in order to continuously drill a deeper borehole. Drill string 184 may be the same or similar to any drill string as described in U.S. patent application Ser. No. 18/377,616, filed on Oct. 6, 2023, titled, "HIGH PRESSURE FLUID JET DRILL SYSTEM," the entire contents of which are hereby incorporated by reference. Drill string 184 may be made up of identical lengths of drill string coupled to one another to affect fluid communication throughout the entire series of drill string 184.

In accordance with an aspect of this disclosure wherein the cutting fluid flows around the outside of the drill string (but within the drill casing 116), and fluid returns (with debris/cuttings) through the center of the drill string is advantageous in that it:

i. reduces the amount of volume required for a given flow velocity,
ii. increases the rock (or debris) diameter that can pass through outflow channel 124 for a lower volume;
iii. reduces the required borehole diameter;
iv. allows for drilling fluid to pass unobstructed through all the components of the drill system;
v. allows for smaller components which can fit inside the borehole; and
vi. provides cheaper and simpler components.

Drill string 184 may be primarily ISO standard "black" pipe and/or ANSI schedule steel pipe. The length of drill string can be any length based on whatever pipe length is cut then add the connectors to the end. Drill string 184 may be configured to connect any two components within the drill string, including another drill string connector. For example and without limitation, there may be a plurality of drill strings sections 184 in series in order to extend the drill string down a borehole. This disclosure does not seek to limit the number of drill string lengths 184 that may be connected in series or between a certain number of components.

Drill string 184 may include an outer tube matched to the inner diameter or less than the diameter of the inner surface of inner cylinder 104. For example and without limitation, a length of drill string 184 may include an outer tube concentrically and surrounding an inner tube. The inner tube may be ½" inch nominal diameter. The outer tube may be a 1" inch nominal diameter. The inner tube and outer tube may form an annular flow channel therebetween. The annular flow channel may be in fluid communication with pressure feed port 168 as described herein. The annular flow channel may be emplaced at the same diameter within the drill string 184 as the pressure feed port 168 are emplaced in the main rotary shaft 148.

In various embodiments, drill string 184 may include a male connector threaded onto the outer tube of the drill string 184, the male connector emplaced around a portion of inner tube of the drill string 184. The male connector may include internal threads configured to mate with threads on the outer tube and external drill string connector threads configured to be threaded onto one or more corresponding threads to another female connector as will be described below. Male connector may have a male retaining feature. Male retaining feature rings may be configured to hold the inner pipe in place and keep it from sliding up and/or down within the outer tube of the drill string 184. The male retaining feature may have one or more grooves or holes formed therein to allow for high pressure fluid flow to pass therethrough and into the next section of drill string 184. The male retaining feature may include a filter membrane emplaced therein configured to filter out any debris traveling up the outflow channel, which is in fluid communication with outflow 164. In various embodiments, the male retaining feature may include a filter membrane configured to filter out any debris traveling downward through the annular flow channel.

Drill string 184 may include a female connector. Female connector may be emplaced at an end of the outer tube and inner tube of the section of drill string 184. Female connector may include a first end and a second end defining a cylindrical length therebetween. The female connector may include internal threads on both of the first and second ends. The internal threads of the first end may be configured to thread onto corresponding threads of the outer tube and receive inner tube there within. In various embodiments, inner tube may be longer than outer tube, the inner tube extending past the end of the outer tube.

Female connector also includes internal threads within the second end. The second end's internal threads are configured to thread onto the external threads of a male connector from an adjacent drill string 184. Female connector may include a female retaining feature. Female retaining feature rings may be configured to hold the inner pipe in place and keep it from sliding up and/or down within the outer tube. The female retaining feature may have one or more grooves or holes formed therein to allow for high pressure fluid flow to pass therethrough and into the other wide of the drill string 184. Female retaining feature ring is extended to form the female bore seal to connect the two lengths of inner pipe.

Drill string 184 may include one or more outer tube O-rings. There may be one or more channels or grooves within the outer tube configured to retain or partially seat the O-ring within. In various embodiments, the channels or grooves may include crush ring seals. The O-ring or crush seals may be configured to form a fluid seal between the male and the female connectors of a connected drill string 184. Drill string 184 may include one or more inner tube O-rings. There may be one or more channels or grooves within the inner tube configured to retain or partially seat the O-ring within. The O-ring may be configured to form a fluid seal between the inner tube and the female connector of a connected drill string 184. In various embodiments, one or more casings may be coupled to the outer surface of the drill string 184. The casing may be a generally cylindrical wall having an inner surface coupled to the drill string 184 and an outer surface configured to abut or form a near seal to the borehole within which the drill string is disposed. The casing may be rotatably coupled to the drill string 184 such that the drill string 184 may rotate within the casing. The casing may be fixedly coupled to the drill string 184 and sized to fit within inner cylinder 104.

With continued reference to FIG. 8, system 800 may include a drill head 188. Drill head 188 may be the same or similar to any drill head as described in U.S. patent application Ser. No. 18/377,616, filed on Oct. 6, 2023, titled, "HIGH PRESSURE FLUID JET DRILL SYSTEM," the entire contents of which are hereby incorporated by reference. Drill head 188 may be coupled to the terminal end of the lower section of drill string 184. Drill head 188 may be configured to eject high pressure fluid towards material at the bottom of a borehole to drill the borehole. In various embodiments, drill head 188 may be configured to conduct cuttings and fluid after ejection up through an outflow portion, the entire length of drill string 184 and out through outflow 168.

Drill head 188 may be generally cylindrical in construction (with varying diameters along its length), with the cutting action occurring at the conical surface extending distally from the cylindrical drill body. Drill head 188 may be formed as an inverted cone, with the apex of the conical surface disposed downward and configured to be at the bottom of the borehole proximate the cutting action. The apex of the cone of the drill head 188 may be configured to push unbroken large cuttings out of the way to allow downward progress in target materials above bedrock. In situations below bedrock, the inverted cone drill head 188 may be configured to hold unbroken large cuttings in the area where the fluid jets are ejected from the nozzles (which are disposed on the conical surface) which aids in breaking down or cutting the large cuttings further to be removed through an outflow channel in fluid communication with outflow 164.

Drill head 188 may include drill string connector threads 104 configured to connect drill head 188 to one or more preceding components, the entire assembly or a subset of that assembly may be referred to as the drill string.

Drill head 188 may include a generally cylindrical construction, the cylindrical construction may be sized based on intended borehole to be drilled. Drill head 188 may be formed with a generally cylindrical construction aligned with the vertical axis, or any axis parallel to the borehole intended to be drilled by drill head 188. Drill head 188 may be formed with a radially symmetrical cross section. Drill head 188 may be formed with a square cross section, triangle cross section, pentagonal, hexagonal, heptagonal, octagonal or higher number of equally spaced and symmetrical sides. For example and without limitation, one or more ports may be disposed in one or more sides of the drill head 188.

Drill head 188 may include a high pressure flow channel. There may be as many channels, fluid lines, or components configured to feed high pressure fluid to one or more nozzles as required. For example there may be four nozzles and high pressure flow channels equally and radially spaced about a central axis, each nozzle spraying towards central axis; though alternative numbers of channels are within the scope of the present disclosure. The high pressure flow channels can be configured as discrete separate channels at select axial/longitudinal locations (e.g., circumferentially spaced orifices), with some/all of these channels merging to be in fluid communication with a single/common source of upstream fluid (e.g. water) for cutting, as described in further detail below. Also, each of these high pressure fluid channels can have a dedicated/single path of fluid travel (e.g. from proximal end to distal end to be dispensed and perform the cutting operation).

In various embodiments, drill head 188 is configured to intake high pressure fluid through high pressure flow channel(s) continuously, in steps, parts, bursts and/or pulses. In various embodiments, high pressure flow channel may be interchangeable within drill head 188, such as being disposed in a removable portion of drill head 188 of through one or more access ports. In various embodiments, wherein high pressure flow channel is a recess or machined channel, there may be access ports in drill head 188 to allow access or maintenance to the inlet.

In various embodiments, flow channel may include one or more filters disposed therein. The one or more filters may be partially or fully annular and may be disposed at any point along flow channel. For example, and without limitation, the one or more filters may be disposed where two components meet and are threaded together, thereby providing compression to hold the filter in place within flow channel. In various embodiments, the radial tension of the filter may secure the filter within flow channel. In operation, high pressure fluid (e.g. water) is delivered through any vertical or horizontal bore and "turns", e.g. 90°, to enter one or more nozzles, ports, channels, or the like for ejection to drill the desired substrate.

Drill head 188 includes an outflow channel in fluid communication with the drill strings 184 and pressure feed port 164. The outflow channel may be centrally and longitudinally extending through the radial center of the drill head 188. In various embodiments, outflow channel may be a cylindrical and radially symmetrical channel extending unobstructed through the drill head 188.

In various embodiments, outflow channel may be off-center. In various embodiments, outflow channel may be branched, having secondary or further channels extending therefrom. In various embodiments, outflow channel may have one or more openings formed within the cylindrical wall at various points extending through the drill head 188.

In various embodiments, outflow channel may be disposed at an angle to the longitudinal axis of drill head 184. The outflow channel can have a dedicated/single path of fluid travel that is opposite the high pressure flow channel (s)—for example, from distal end to proximal end to excavate the debris (or "cuttings") removed during cutting. Also, the diameter of the outflow channel can be larger than each high pressure flow channel(s) (e.g., in some embodiments the diameter of outflow channel is approximately equal to the aggregate/sum of diameters of the high pressure channels).

In various embodiments, outflow channel may terminate/originate at a conical surface portion of drill head 188 in one or more return feed inlets. In various embodiments, return feed inlet may be a single inlet disposed about the conical surface of drill head 188. In various embodiments, return feed inlet may be more than one opening radially symmetrically about the longitudinal axis of drill head 188.

In various embodiments, return feed inlet may be configured to intake cuttings and earth that have been pulverized by the drill head and brought up the outflow channel towards the surface of the borehole. In various embodiments, outflow channel may be subjected to a negative pressure from one or more fluids moving in another component of drill head 188.

In various embodiments, return feed inlet may be disposed parallel to the bottom of the borehole such that the openings are perpendicularly disposed to the longitudinal axis of the drill head 188. In various embodiments, a drill inlet portion having the return feed inlets may attach to the bottom of the drill head 188 and filters material so large objects do enter the return stream going up and through the outflow channel. In various embodiments, the return feed inlet may be smaller in diameter than outflow channel, thus anything that passes through return feed inlet may pass through outflow channel without becoming stuck and hinder flow.

Drill head 188 may include one or more nozzles where fluid is dispensed to cut/advance the borehole. In this embodiment, a drill head 188 is provided which has more than one nozzle that connect to one or more high pressure fluid passages. As pressure is generated inside of the drill head, high velocity fluid streams are forced through the nozzles (which can rotate, or be rotated statically with the drill head 1) and directed at the substrate.

When the high velocity fluid streams meet with the substrate, the kinetic energy is converted into a high pressure region which fractures/cuts the substrate surface. Additionally or alternatively, the drill head may have multiple nozzles along the surface of the cone pointing tangentially or near tangentially to the cone's surface. Each of the multiple nozzles may be supplied with individual sources of high pressure fluid or may connect to a central high pressure source passing through the central axis of the cone.

The nozzle converts the high pressure fluid into a high velocity stream along a straight trajectory. In various embodiments, nozzle may convert the high pressure fluid into a high velocity stream along multiple straight trajectories. In various embodiments, nozzle may convert the high pressure fluid into a high velocity stream for each of a plurality of orifices disposed in nozzle.

In various embodiments, the nozzles may have more than one orifice, such as branched orifices, where each of the plurality of orifices of an individual nozzle may branch from a single fluid conduit fed by the high pressure inlet. In various embodiments, each nozzle may have three orifices, each orifice angularly spaced from an adjacent by 90 degrees, each orifice fed by a single fluid conduit. In various embodiments, each of these three orifices on the single nozzle may be configured to eject fluid in three separate streams, one perpendicular to the conical surface, and the adjacent two orifices parallel to the conical surface in opposite directions. In various embodiments, the nozzles may be rotated in the conical surface of the drill head 188 to aim the streams ejected therefrom. In various embodiments, the nozzle orientation or angle may be adjusted via piezoelectric elements configured to alter the spray path of the nozzle by changing size in response to one or more electrical signals.

Method for Drilling a Borehole with the Annular Piston Pile Driver

Figure 9:
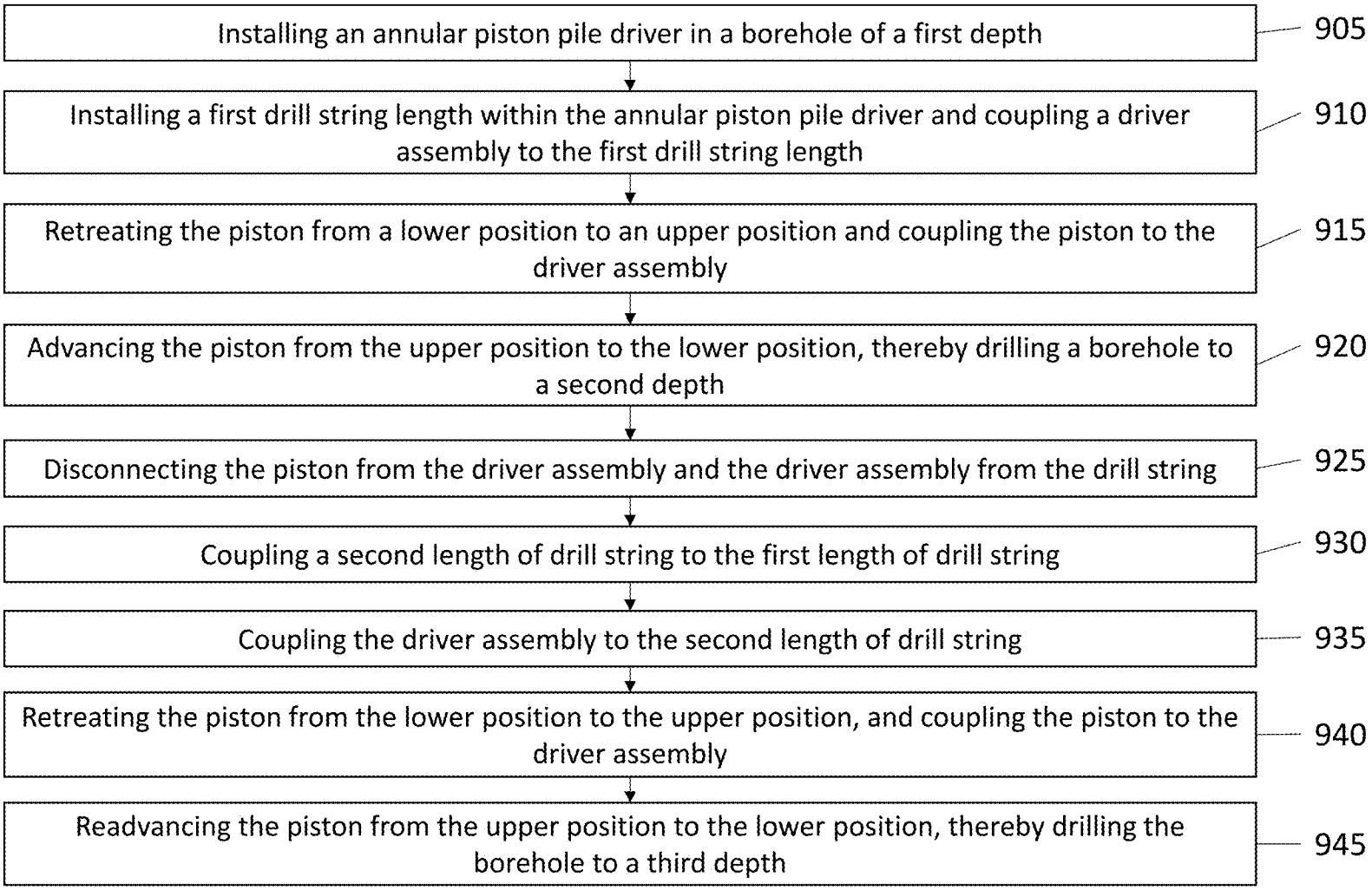
FIG. 9 is a method for drilling a borehole utilizing the annular piston pile driver in accordance with the disclosed subject matter.

Referring now to FIG. 9, a method 900 for drilling a borehole with an annular piston pile driver is shown in flow chart form. The method 900 may be implemented utilizing the annular piston pile driver 100 as described herein, and further with the system 800 which includes the annular piston pile driver 100. The method may include forming an initial borehole having a first depth. Forming the initial borehole having a first depth may be performed using a posthole digger or another apparatus for forming an opening or hole in a substrate, such as earth concrete, cement or another target area. In various embodiments, the initial borehole may be sized to receive the annular piston pile driver 100 as described herein. For example, the initial borehole may be sized to have the approximate outer diameter of the outer cylinder 108 and extend down a length equal or approximately equal to the length of the outer cylinder 108 as measured from the lower end to the lower face of the mounting plate 128, which retains the annular piston pile driver 100 at ground level and suspended in the initial borehole. Further, the method may include sealing the initial borehole by providing mechanical fasteners in the mounting plate 128. In various embodiments, sealing foam or another material may be emplaced around the ground plate 128 to form a seal within the initial borehole.

Figure 10A:
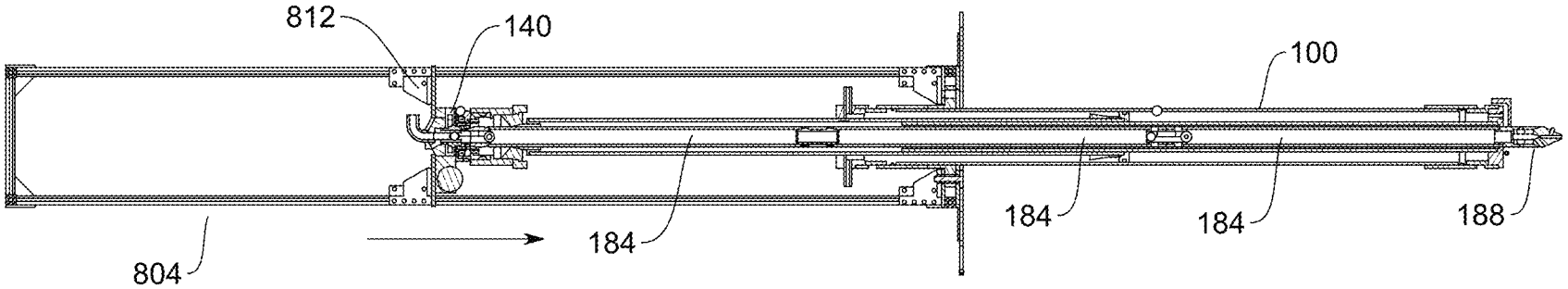
FIGS. 10A-10E are a series of cross-sectional views of the system for drilling boreholes utilizing the annular piston pile driver at various points in the drilling and drill string extension steps, in accordance with the disclosed subject matter.
Figure 12B:
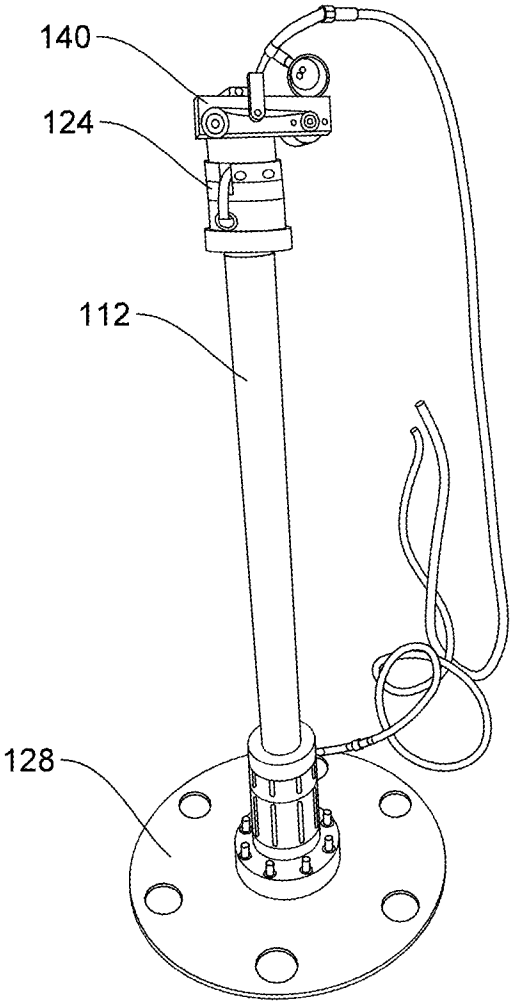
FIGS. 12A-12B are perspective views of the annular piston pile driver installed in the ground and the annular piston pile driver in an extended state with driver assembly coupled thereto, respectively, in accordance with the disclosed subject matter.
Figure 12A:
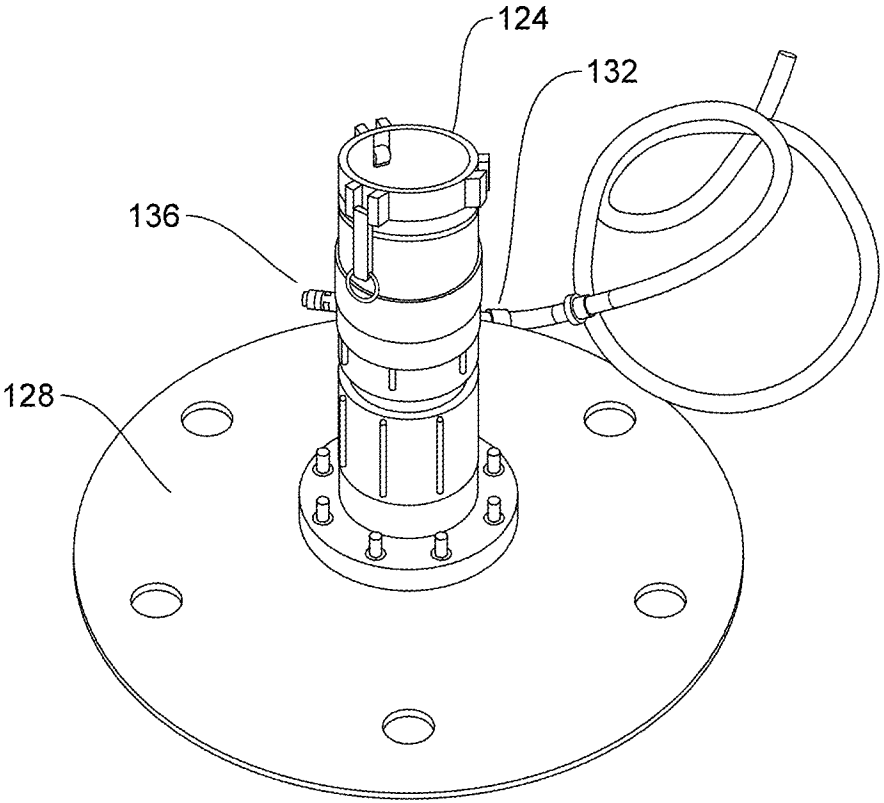

With continued reference to FIG. 9, method 900 includes, at step 905, installing the annular piston pile driver 100 in the borehole having a first depth as shown in FIGS. 12A-12B. The annular piston pile driver 100 may include the driver assembly 140, drill string 184 extending through the annular piston pile driver and drill head 188 coupled to a lower end thereof, as shown in FIG. 10A. In various embodiments, the annular piston pile driver 100 may be placed within the initial borehole without a drill string disposed therein. The annular piston pile driver 1!00 may be configured to accept a drill string having a drill head emplaced thereon through a central bore extending from the driver coupling 124 to the opposite end of the lander.

With continued reference to FIG. 9, method 900 includes, at step 910, installing a first length of drill string within the annular piston pile driver 100, and coupling the driver assembly 140 to the first length of drill string. In various embodiments, the annular piston pile driver 100 may be inserted within the first borehole having the drill string lengths already installed within it, in such a case, the method may include immediately advancing the piston from an upper position to a lower position, thereby drilling the borehole to a second depth. In various embodiments, the annular piston pile driver 100 may be configured to be installed with the drill string already installed within it, with the piston in the lowest position, in such a case, drilling operations may commence to begin drilling the borehole. The piston may be lowered under the power of hydraulic or pneumatic fluid acting on the piston head, as described herein. FIG. 10A shows the piston at some point in its travel from the extreme extended and lowered positions, with the drill head exiting the lower end of the inner cylinder.

With continued reference to FIG. 9, method 900 includes, at step 915, retreating the piston from a lower position to an upper position and coupling the piston to the driver assembly. Retreating the piston may be the same as extending the piston from the lower position to the upper position. As described herein, the piston may be acted upon by hydraulic or pneumatic fluid interacting with the piston head within the annular space of the pile driver. In various embodiments, fluid may be forcibly removed from an upper chamber, affecting a vacuum and pulling the piston up through the pile driver. In various embodiments, fluid may be forcibly provided to the annular space below the piston head, thereby forcing the piston upwards through the pile driver. In various embodiments, fluid may be removed from the upper annular space and provided to the lower annular space simultaneously to raise the piston. With continued reference to FIG. 9, method 900 includes, at step 915 may also include coupling the driver assembly to the second length of drill string. Coupling the driver assembly 140 to the drill string may include threadedly coupling the driver assembly 140 to the drill string threads. In various embodiments, coupling the driver assembly 140 to the first length of drill string may include placing the threads of the main rotary shaft 148 on the drill string 184 and running the driver assembly 140 in order to automatedly thread the components together. In various embodiments, one or more sealants may be placed on the threads or any other sealing surface.

With continued reference to FIG. 9, method 900 includes, at step 920, advancing the piston from the upper position to the lower position, thereby drilling the borehole to a second depth. As the piston advances, it may counteract the weight of the drill string coupled thereto via the driver assembly 140. The piston itself may not exert any downward force on the drill string forcing it through the ground as it drills. For example, the piston may be configured to advance at rate matched with the progress of the drilling operation, thereby controlling the advancement of the drill string as it removes material from a target location. As described herein, the piston may be acted upon by hydraulic or pneumatic fluid interacting with the piston head within the annular space of the pile driver. In various embodiments, fluid may be forcibly provided under pressure to the annular space above the piston head, forcing the piston downwards, with the drill string with it. In various embodiments, fluid may be forcibly removed from the annular space below the piston head, thereby forcing the piston downwards through the pile driver. In various embodiments, fluid may be provided from the upper annular space and removed from the lower annular space simultaneously to lower the piston controllably.

Figure 10B:
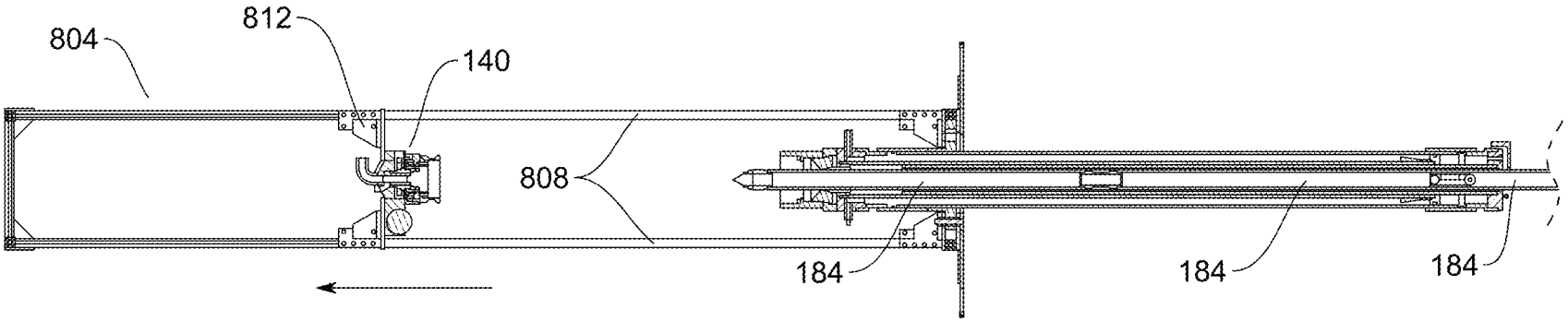

With continued reference to FIG. 9, method 900 includes, at step 925, disconnecting the piston from the driver assembly and the driver assembly from the drill string. Removing the driver assembly 140 may include disconnecting the driver assembly 140 from the driver coupling 124 in one or more additional steps. For example, the driver coupling 124 may include quick connect cams that disengage from a surface of the driver assembly 140 when interacted with. In various embodiments, disconnecting the piston from the driver assembly 140 may further include advancing the piston downward such that the driver coupling 124 is out of interference with the driver assembly 140 and thereby exposes the drill string within. One or more users may grab hold of the drill string with their hands or a tool in order to hold the drill string from rotating, the driver assembly 140 may be run in reverse thereby unthreading the driver assembly 140 from the drill string 184. The driver assembly 140 may also be removed from interference with the aft end of the drill string by sliding along rails 808 of the frame 804. Driver assembly 140 may be held in place by said frame 804 having selective locking or retainment features thereon. Said first drill string length is disposed underground with the aft end of the first drill string length proximate the driver coupling 124. FIG. 10B shows the driver assembly 140 being slid upward along the frame 804, exposing either the driver coupling 124 for disconnection, or the aft end of the first drill string length, or both.

Figure 10C:
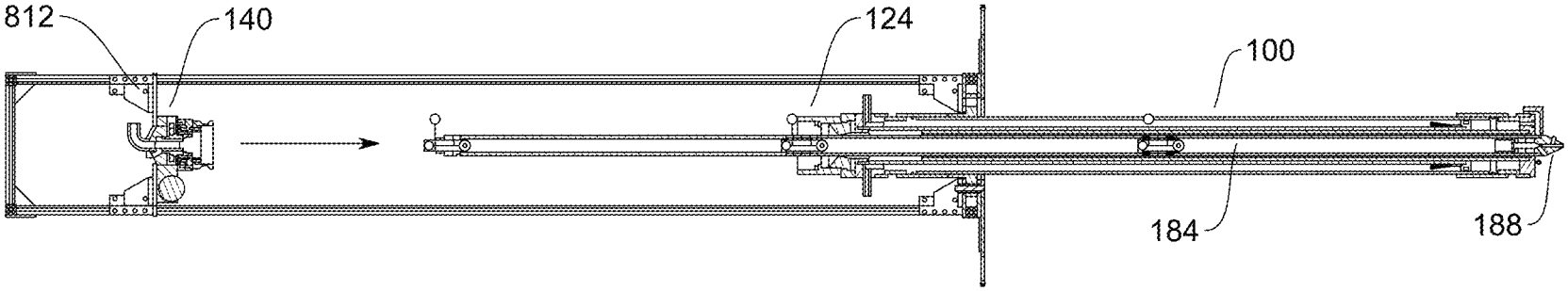

With continued reference to FIG. 9, method 900 includes, at step 930, coupling a second drill string length to the first drill string length. Coupling the drill string lengths may include threading complementary connectors on each length together, such as a matching male and female coupling, as described herein. In various embodiments, one or more connector components may be utilized to connect lengths of drill string. In various embodiments, any axial or annular openings within the first drill string length may be in fluid communication with any subsequent lengths of drill string over an arbitrarily long drill string. Said openings may be in fluid communication with the pressure feed and outflow of the driver assembly 140. FIG. 10C shows a length of drill string coupled to the first length of drill string extending through the annular piston pile driver 100. Said new drill string length may extend above the borehole and therefore above ground. In various embodiments, the drill string length may be matched to the travel length of the piston as described herein. As the plurality of drill strings can be connected, in series, via threaded couplings, in some embodiments the lander will only operate to rotate the aggregate drill string assembly in a single direction (e.g. clockwise) so as to avoid any risk of decoupling drill strings by inadvertent unthreading the union.

With continued reference to FIG. 9, method 900 includes, at step 935, coupling the driver assembly to the second length of drill string and the piston. Coupling the driver assembly 140 to the drill string may include threadedly coupling the driver assembly 140 to the drill string threads. In various embodiments, coupling the driver assembly 140 to the first length of drill string may include placing the threads of the main rotary shaft 148 on the drill string 184 and running the driver assembly 140 in order to automatedly thread the components together. In various embodiments, one or more sealants may be placed on the threads or any other sealing surface.

Figure 10D:
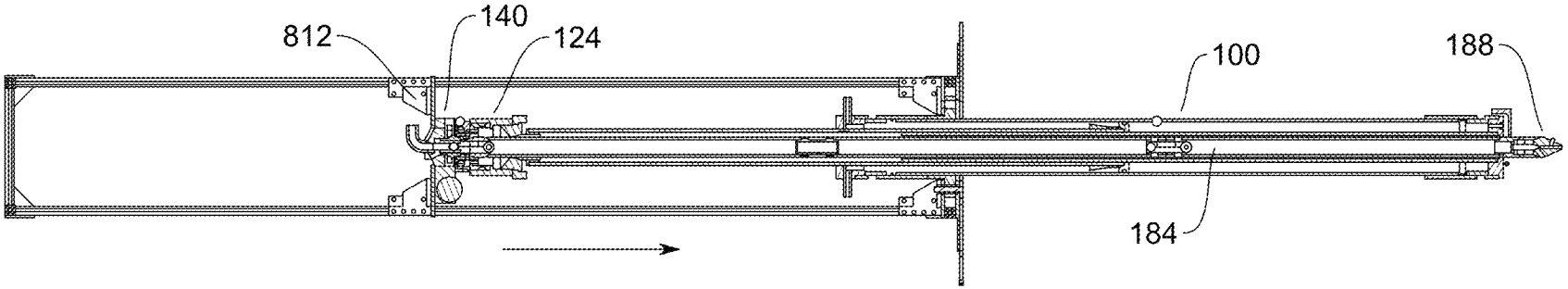

With continued reference to FIG. 9, method 900 includes, at step 940, retreating the piston from the lower position to the upper position, and coupling the piston to the driver assembly. In various embodiments, retreating the piston to the upper position includes retreating the driver coupling 124 proximate the driver assembly 140 to be coupled via the quick connector 180. FIG. 10D shows the driver assembly 140 coupled to the new drill string length and the driver coupling 124, now ready to be actuated and provide fluid to the drill and pile driver, thereby ejecting fluid from the drill head, rotating the drill and translating the drill downward.

Figure 10E:
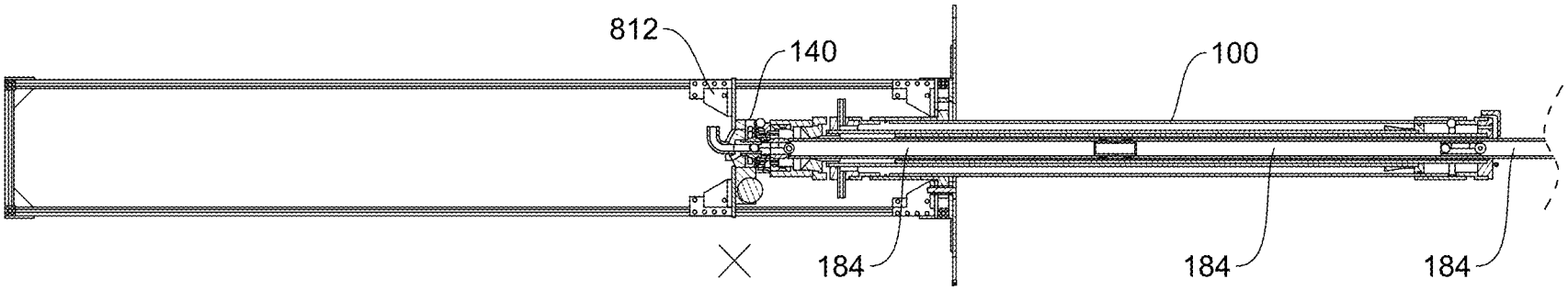

With continued reference to FIG. 9, method 900 includes, at step 945, readvancing the piston from the upper position to the lower position, thereby drilling the borehole to a third depth. By coupling the driver to the piston and the drill string, the annular piston pile driver is ready to be actuated, thereby providing fluid to the drill via the driver assembly, and providing rotation of the drill string via the driver assembly 140. Additionally, the vertical travel of the drill string may be controlled via translational movement of the piston. FIG. 10E shows the system at its lowest position, with the drill string now extending out of frame within the plane of the page, the process as described herein may be repeated n times to provide a drill string of sufficient length to drill a thin, long borehole. Readvancing the piston may affect linear control of the drill string as it removes material from the borehole, as described above, the drill string may rotate via the driver assembly 140 and advance linearly via the piston 112, said driver assembly 140, as described herein, may be configured to conduct fluid in and out of the drill string via pressure feed 168 and outflow 164.

While the disclosed subject matter is described herein in terms of certain preferred embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. An annular piston pile driver, comprising:

an inner cylinder having an upper end and a lower end, extending along a first axis therebetween;

an outer cylinder having an upper end and a lower end, the outer cylinder circumscribing the inner cylinder and extending along the first axis, wherein the inner cylinder and an outer cylinder form an annular space therebetween;

a piston comprising a piston shaft having an upper end and a lower end, and a piston head disposed at the lower end thereof, wherein the piston is disposed within the annular space and configured to travel along the first axis;

a driver coupling releasably coupled to the piston shaft and disposed at the upper end of the piston shaft;

an upper sealing component disposed at the upper end of the outer cylinder and the piston shaft;

a lower sealing component disposed at the lower end of the outer cylinder and the inner cylinder; and a driver assembly coupled to the driver coupling, the driver assembly including:

a housing having a cavity extending along the first axis;

a main shaft disposed within the cavity and extending along the first axis;

a main shaft gear circumscribingly fixed to the main shaft, the main shaft gear configured to rotate about the first axis;

a driving gear extending along a second axis within the housing, the driving gear configured to mesh with the main shaft gear, wherein the second axis is perpendicular to the first axis;

a roller bearing disposed about the main shaft and configured to rotate within the cavity; and a return feed outlet extending from the main shaft into the housing.

2. The annular piston pile driver of claim 1, wherein the annular space comprises a pressure feed port extending through the outer cylinder.

3. The annular piston pile driver of claim 2, further comprising a fluid source coupled to the pressure feed port, the fluid source in fluid communication with the annular space.

4. The annular piston pile driver of claim 3, wherein the fluid source comprises a pump configured to provide a pressurized fluid to the annular space.

5. The annular piston pile driver of claim 4, wherein the fluid is water.

6. The annular piston pile driver of claim 4, wherein the fluid is air.

7. The annular piston pile driver of claim 1, wherein the annular space comprises a pressure release valve extending through the outer cylinder.

8. The annular piston pile driver of claim 1, further comprising a drill string extending along the first axis within the piston shaft and the inner cylinder, wherein the drill string is configured to translate along the first axis and rotate within the inner cylinder.

9. The annular piston pile driver of claim 8, wherein the driver assembly is threadably coupled to the drill string.

10. The annular piston pile driver of claim 9, further comprising a motor coupled to the driving gear, the motor configured to rotate the driving gear, thereby further rotating the main shaft and the drill string.

11. The annular piston pile driver of claim 1, further comprising a frame fixed to the outer cylinder, wherein the frame comprises:

at least one member extending along the first axis; and a sliding carriage coupled to the at least one member, the sliding carriage configured to translate along the first axis.

12. The annular piston pile driver of claim 11, wherein a drill string is coupled to the sliding carriage.

13. The annular piston pile driver of claim 1, wherein the lower sealing component comprises at least one of a pressure feed port and a vent.

* * * * *